US012410632B2

(12) United States Patent
Touhey et al.

(10) Patent No.: US 12,410,632 B2
(45) Date of Patent: Sep. 9, 2025

(54) SELF-DEPLOYING SHELTER

(71) Applicant: Pvilion Technologies, LLC., Brooklyn, NY (US)

(72) Inventors: Colin Touhey, Brooklyn, NY (US); Robert Lerner, Port Washington, NY (US); Todd Dalland, New York, NY (US); Joseph Corsi, Phoenixville, PA (US)

(73) Assignee: Pvilion Technologies, LLC., Brooklyn, NY (US)

( * ) Notice: Subject to any disclaimer, the term of this patent is extended or adjusted under 35 U.S.C. 154(b) by 0 days.

(21) Appl. No.: 17/946,713

(22) Filed: Sep. 16, 2022

(65) Prior Publication Data

US 2023/0151632 A1 May 18, 2023

Related U.S. Application Data

(60) Provisional application No. 63/244,967, filed on Sep. 16, 2021.

(51) Int. Cl.
*E04H 15/48* (2006.01)

(52) U.S. Cl.
CPC ..... *E04H 15/48* (2013.01)

(58) Field of Classification Search
CPC ..... E05H 15/48
See application file for complete search history.

(56) References Cited

U.S. PATENT DOCUMENTS

| | | | | |
|---|---|---|---|---|
| 1,502,898 | A * | 7/1924 | Berg | E04H 15/28 135/147 |
| 5,230,358 | A * | 7/1993 | Forell | E04H 15/322 135/133 |
| 5,499,646 | A * | 3/1996 | Lee | E04H 15/28 135/96 |
| 7,644,721 | B2 * | 1/2010 | Hoberman | E04H 15/52 52/79.5 |
| 8,186,369 | B2 * | 5/2012 | Reeb | E04H 15/48 135/147 |
| 8,496,019 | B2 * | 7/2013 | Zhou | E04H 15/48 135/147 |
| 2009/0078297 | A1 * | 3/2009 | Bae | E04H 15/48 135/120.2 |
| 2010/0229905 | A1 * | 9/2010 | Lin | E04H 15/48 135/96 |

(Continued)

*Primary Examiner* — David R Dunn
*Assistant Examiner* — Danielle Jackson
(74) *Attorney, Agent, or Firm* — Ziegler IP Law Group, LLC

(57) ABSTRACT

A self-deploying shelter assembly deploys between a unfolded and folded state automatically. The shelter includes a plurality of legs and a hub, the hub being configured to be coupled to one end of a leg. A leg has a first element, a second element and a third element. A second end of the third element is movably coupled to the hub. A foot member is coupled to a first end of the first element. A second end of the first element is movably coupled to a first end of the second element and a second end of the second element is movably coupled to the first end of the third element. A roller member is coupled to one or more of the second end of the second element and the first end of the third element and is configured to contact a ground surface when the shelter is folded.

18 Claims, 28 Drawing Sheets

(56) References Cited

U.S. PATENT DOCUMENTS

| | | | | |
|---|---|---|---|---|
| 2012/0192907 | A1* | 8/2012 | Zhou | E04H 15/48 135/147 |
| 2014/0338711 | A1* | 11/2014 | Choi | E04H 15/48 135/120.3 |
| 2022/0010581 | A1* | 1/2022 | Yang | E04H 15/48 |

* cited by examiner

SELF-DEPLOYING SHELTER

FIELD

The aspects of the disclosed embodiments generally relate to portable shelters and in particular to a fully autonomous self-deploying shelter system.

BACKGROUND

Portable shelters, also referred to as portable tents, typically require significant manpower and time to install. Historically, portable shelters are set up and torn down utilising multiple persons folding, unfold, erecting and lifting, all using manual power. These portable shelters typically include a frame and fabric. The frame has orientations that can fold, expand, telescope, or bend. The fabric is attached to the frame or can be independent. The set up generally requires knowledge of the complex setup sequence and the ability to open, erect and close or disassemble the shelter. This requires significant manpower capability.

Attempts at simplifying the process of tent installation have been made by using complex joints, scissor truss folding systems, pin joints, and inflatables. Generally, these will have a very large number of folding frame members that are subject to frequent parts damage and failure. There are typically many ground contact points that must travel across irregular ground surfaces to reach final geometry.

Thus, there is a need for improved systems, apparatus and methods for portable shelters. Accordingly, it would be desirable to a portable shelter assembly that addresses at least some of the problems described above.

SUMMARY

The aspects of the disclosed embodiments are directed to a self-deploying shelter or tent. By motorizing and remote-controlling the installation the manpower and time requirements can be significantly reduced. The Self-Deploying Shelter of the disclosed embodiments utilizes actuators in the joints and linkages that are able to be controlled by the simple push of a button. Automatic erection and takedown of the Self-Deploying Shelter of the disclosed embodiments allows the physical strength and skill level of the operator otherwise required to be reduced dramatically, saving both time and manpower. The shelter of the disclosed embodiments system does not drag its feet or legs and is configured to lift itself up with a secure base when or as the feet are in their final position, minimizing challenges on rough terrain. The shelter of the disclosed embodiments has a small number of frame members. There are no ground contact points that must travel across irregular ground. The shelter is motorized and remote-controlled.

According to a first aspect, the above and further implementations and advantages are obtained by a self-deploying shelter assembly that is configured to deploy to and from a folded state from an and to an unfolded state in an automated manner. In one embodiment, the shelter assembly includes a plurality of leg members and a hub, the hub being configured to be coupled to one end of respective leg member of the plurality of leg members. A leg member of the plurality of leg members has a first leg element, a second leg element and a third leg element. A second end of the third leg element is movably coupled to the hub. A foot member is coupled to a first end of the first leg element. A second end of the first leg element is movably coupled to a first end of the second leg element and a second end of the second leg element is movably coupled to the first end of the third leg element. A roller member is coupled to one or more of the second end of the second leg element and the first end of the third leg element. The roller element is configured to contact a ground surface when the self-deploying shelter assembly is in the folded, non-deployed state.

In a possible implementation form, the hub is configured to cause a movement of the plurality of legs outward, away from the hub, when the shelter assembly is deploying from the folded state to the unfolded state, and cause a movement of the plurality of legs inward, toward the hub, when the shelter assembly is deploying from the unfolded state to the folded state.

In a possible implementation form, the roller member comprises a curved member that extends from a bottom of the shelter assembly to make contact with the ground surface when the shelter assembly is in the folded state.

In a possible implementation form, the foot member is away from the ground surface, or not in contact with the ground surface, in the folded state of the shelter assembly. The foot member is configured to only make contact with the ground surface once the leg members are deployed, and the hub is ready to move upward to expand the tent portion of the assembly. This way, the foot member does not drag on the ground surface and can be more accurately positioned.

In a possible implementation form, the hub member causes the plurality of leg members to extend outwards. The first leg element and the second leg element extend outwards a pre-determined distance until the foot member comes in contact with the ground surface.

In a possible implementation form, the contact of the foot member with the ground surface while the hub is extending the plurality of leg members causes the hub to move in an upwards direction, away from the ground surface. The hub moves upwards with the leg members which cause the fabric to expand over the leg members as the shelter deploys.

In a possible implementation form, the foot member is disposed closer to the hub than the roller member in the folded state of the assembly. The foot member is away from the ground surface while the roller member is in contact with the ground surface, in the folded state.

In a possible implementation form, the first leg member is pivotally connected to the foot member and the second leg member. The different elements are coupled to each other in a pivotal manner, which enables movement of the elements relative to one another.

In a possible implementation form, the second leg member is pivotally connected to the third leg member.

In a possible implementation form, the roller member comprises a bracket that is pivotally connected to a bracket on the third leg member and an arm element connected to the second leg member. The arced portion of the roller member can extend from, or be part of, the roller member.

In a possible implementation form, the foot member moves along an arced path when moving to and from the folded state and unfolded state of the shelter assembly. The movement of the foot member follows a curved path until it is moved to make contact with the ground surface.

In a possible implementation form, when the shelter assembly deploys from the folded state to the unfolded state, the hub is configured to cause the first end of the first leg member to move in an upward direction away from the ground surface, wherein the first end of the first leg member is moving along the arc path; the first end of the second leg member to move away from a centerline of the hub and third leg member; cause the foot member to come in contact with the ground surface when the first leg member and the second leg member reach pre-determined positions; cause the roller member to move away from the ground surface after the foot member comes in contact with the ground surface and the third leg member extends and cause the shelter assembly to reach the unfolded state once the third leg member is fully extended.

In a possible implementation form, when the shelter assembly deploys from the unfolded state to the folded state, the hub is configured to cause the third leg member to retract from a fully extended position until the roller member comes in contact with the ground surface; the foot member to lift off the ground surface after the roller member comes in contact with the ground surface; and cause the second leg member and the first leg member to retract to the folded state of the shelter assembly, while the foot member moves along the arc path, without further contact with the ground surface.

In a possible implementation form, the third leg member comprises a first leg element spaced apart from a second leg element, a first end of the first leg element and a first end of the second leg element pivotally connected to the hub, and a second end of the first leg element coupled to the roller arm bracket.

In a possible implementation form, an actuator or cable assembly is connected to and between the hub and the plurality of leg members. The actuator or cable assembly is configured to cause movement of one or more of the first leg element, the second leg element and the third leg element when a cable member of the cable assembly is extended and retracted by a cable spool assembly on the hub.

In a possible implementation form a drive motor is connected to the hub and the cable spool assembly, the drive motor configured to cause the cable spool assembly to extend and retract the cable member.

In a possible implementation form, a linkage system is coupled to the plurality of leg members and leg elements, the linkage system configured to cause individual leg members to open to the unfolded state and close to the folded state along a prescribed path.

In a possible implementation form, the linkage system is connected between the hub and the individual leg member of the plurality of leg members.

In a possible implementation form, the linkage system is connected to the actuator or cable assembly.

These and other aspects, implementation forms, and advantages of the exemplary embodiments will become apparent from the embodiments described herein considered in conjunction with the accompanying drawings. It is to be understood, however, that the description and drawings are designed solely for purposes of illustration and not as a definition of the limits of the disclosed invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

In the following detailed portion of the present disclosure, the aspects of the disclosed embodiments will be explained in more detail with reference to the example embodiments shown in the drawings, in which like references indicate like elements and:

In FIG. 3B the roller member is a wheel.

These and other aspects, implementation forms, and advantages of the exemplary embodiments will become apparent from the embodiments described herein considered in conjunction with the accompanying drawings. It is to be understood, however, that the description and drawings are designed solely for purposes of illustration and not as a definition of the limits of the disclosed invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DISCLOSED EMBODIMENTS

Figure 1:
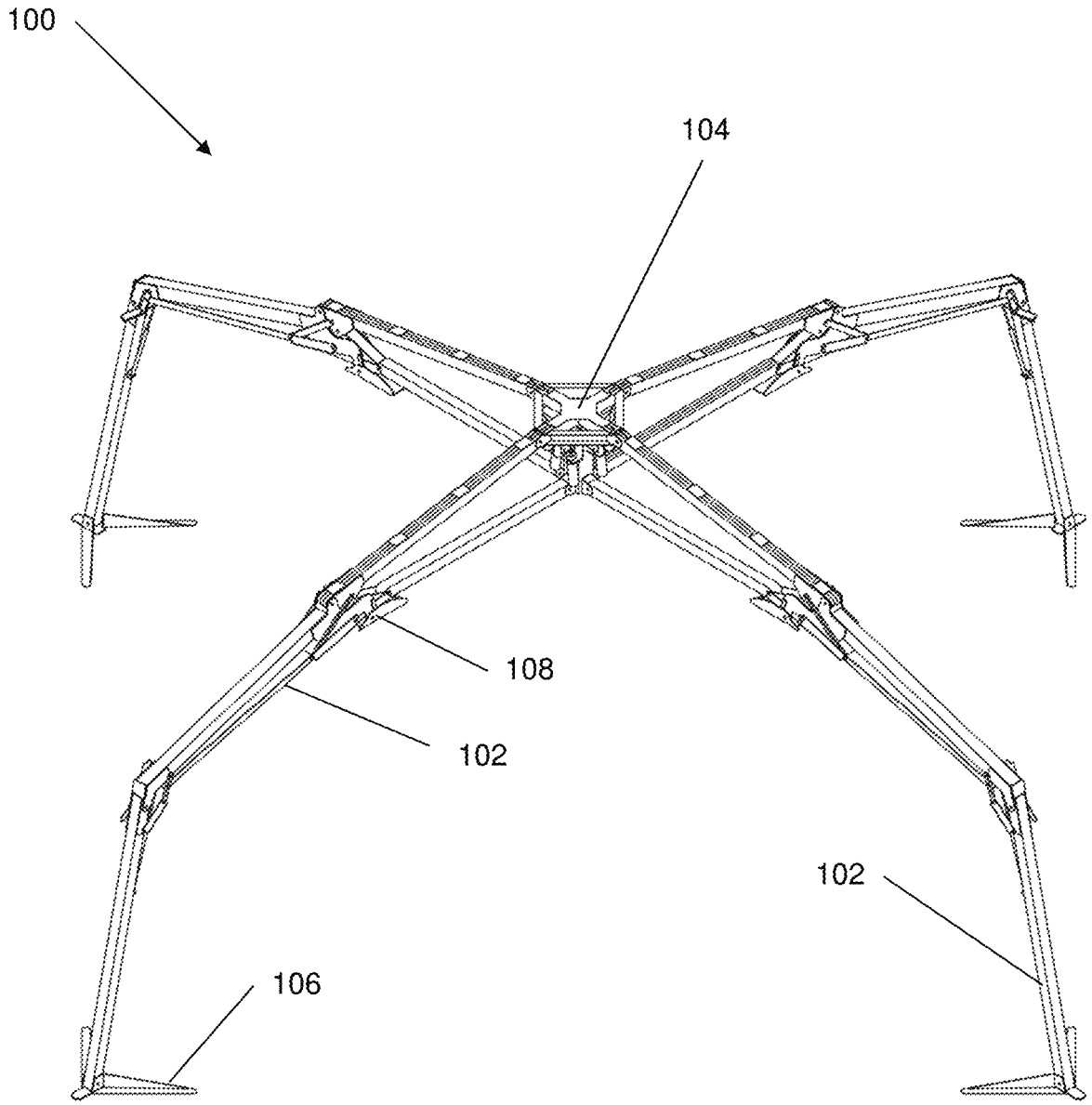
FIG. 1 is a perspective view of an exemplary self-deploying shelter assembly incorporating aspects of the disclosed embodiments.

The aspects of the disclosed embodiments are directed to a rapidly deployable shelter assembly or system, also referred to herein as a hands-off expeditionary tent (HEXT). One example of a shelter assembly 100 incorporating aspects of the disclosed embodiments is illustrated in FIG. 1. The shelter assembly 100 shown in FIG. 1 is configured to be a fully autonomous self-deploying shelter. One advantage of the shelter assembly 100 is that the foot members 106 travel to and from closed to open position without dragging along ground. According to the aspects of the disclosed embodiments as will be described herein, the foot members 106 lift up over the ground, and only make contact when the leg 102 is partially extended.

The self-deploying shelter assembly 100 of the disclosed embodiments is configured to automatically, without manual intervention, deploy to and from a folded state from an and to an unfolded state. In one embodiment, the shelter assembly 100 includes a plurality of respective leg members 102 and a hub 104. The hub 104 is configured to be coupled to one end of a respective leg member 102 of the plurality of leg members.

A leg member 102 of the plurality of leg members has a first leg element, a second leg element and a third leg element. A second end of the third leg element is movably coupled to the hub 104. The foot member 106 is coupled to a first end of the first leg element. A second end of the first leg element is movably coupled to a first end of the second leg element. A second end of the second leg element is movably coupled to the first end of the third leg element.

A roller member 108 is coupled to one or more the second end of the second leg element and the first end of the third leg element. The roller element 108 is configured to contact a ground surface when the self-deploying shelter 100 is in the folded or non deployed state.

As is illustrated in FIG. 1, the assembly 100 is generally in the form of a cross-arched frame structure, with four (4) or more legs 102. The individual legs 102 are generally comprised of three (3) segments that are configured to be folded in a zigzag pattern. Although the assembly 100 is generally described herein with respect to four legs, the aspects of the disclosed embodiments are not so limited. In alternate embodiments any suitable number of legs can be used other than including four. For example, the assembly 100 can include three or five legs. The number of legs 102 can be dependent upon a variety of factors such as, for example, the size of the assembly 100 and the particular implementation. The legs 102 shown in the example of FIG. 1 can comprise multiple structural elements, also referred to herein as arms. The legs 102 are made up of structural elements, pins, and linkages that move the assembly 100 through a prescribed motion path.

As shown in the example of FIG. 1, in one embodiment, the assembly 100 includes a hub 104. The hub 104 will generally include the components and devices that will allow the assembly 100 to transition from an unfolded state to a folded state, and back to the unfolded state. One example of the transition from the folded state to the unfolded state is shown in FIG. 2.

Figure 2:
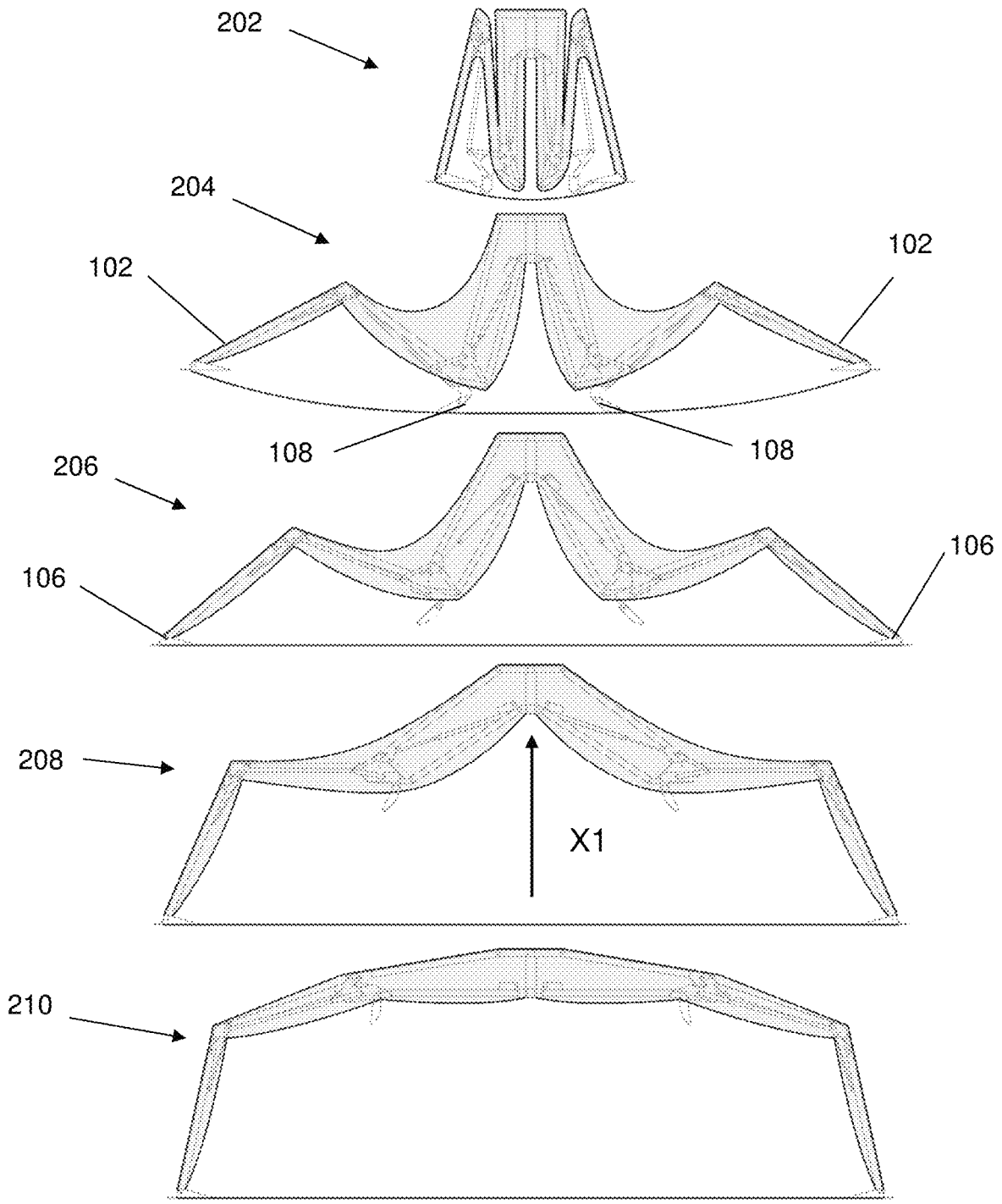
FIG. 2 illustrates the unfolding and folding of an exemplary self-deploying shelter assembly incorporating aspects of the disclosed embodiments.

As is shown in FIG. 2, the legs 102 are configured to open from the middle and reach their final position before lifting. The legs 102 do not drag on the ground surface during the opening and closing process.

FIG. 2 illustrates five (5) autonomous stages of the deployment of the assembly 100. In 202, the assembly 100 is in the folded state. The ends of the legs 102, also referred to as a foot 106, are not in contact with the ground surface in the folded state.

Figure 3A:
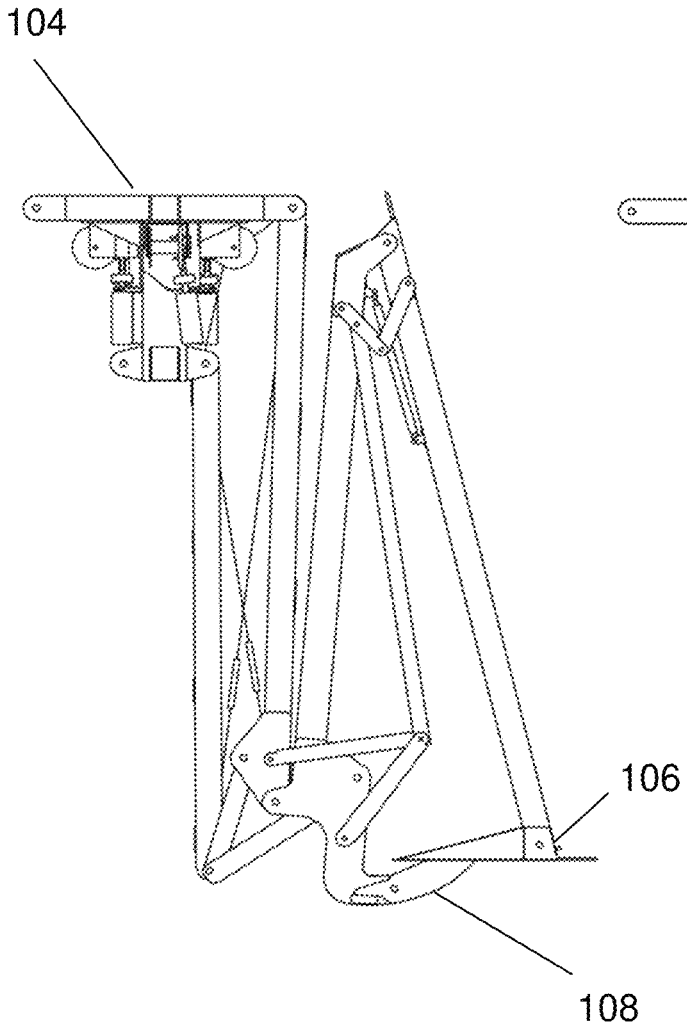
FIGS. 3A and 3B are side views of an exemplary self-deploying shelter assembly incorporating aspects of the disclosed embodiments, with different roller members.
Figure 3B:
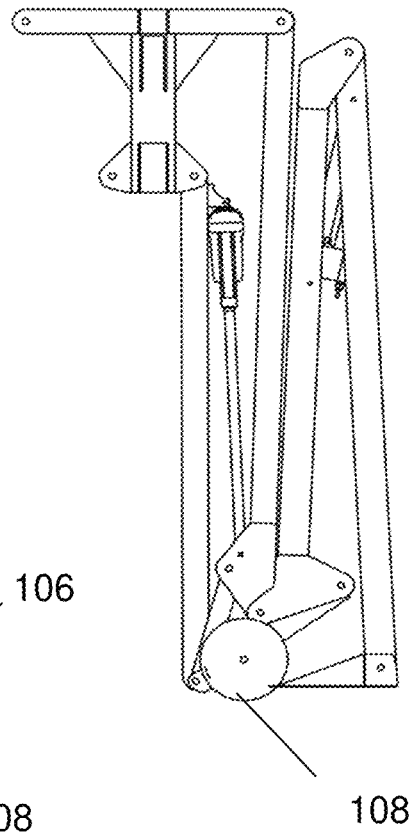
Figure 4:
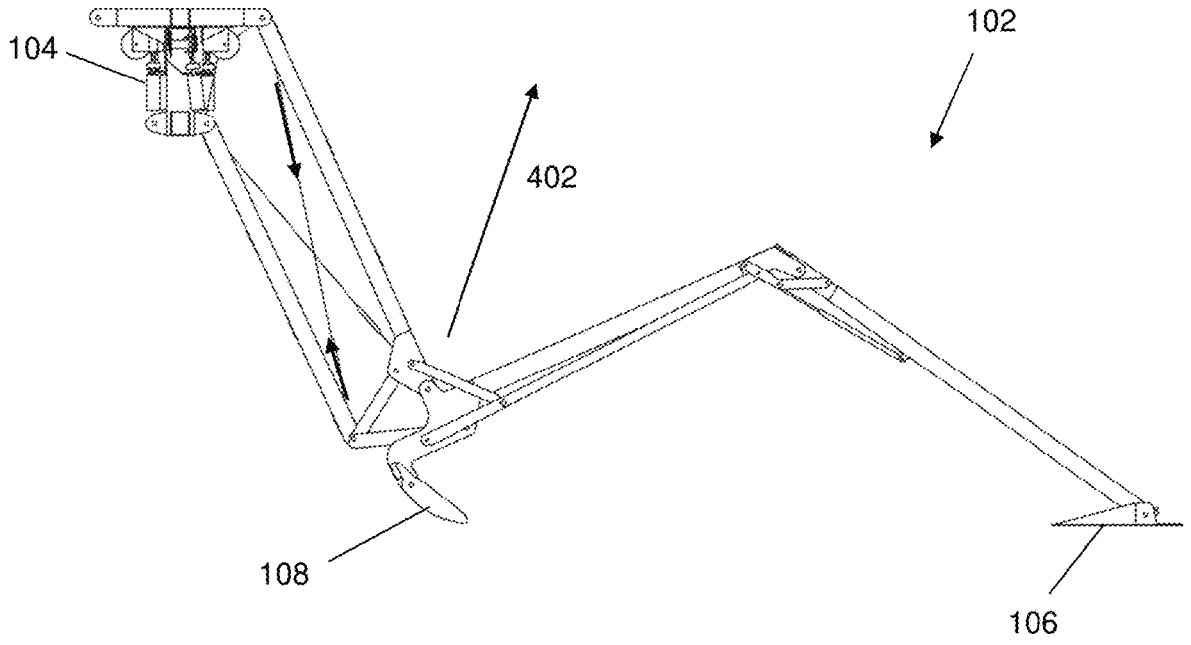
FIG. 4 illustrates a partially unfolded or folded exemplary self-deploying shelter assembly incorporating aspects of the disclosed embodiments.

In 204, roller members 108, more clearly illustrated in FIGS. 3 and 4, are shown in contact with the ground or floor as the hub 104 causes the legs 102 begin to extend outwards. The roller members 108 are attached to the frame of the assembly 100 using, for example, structural pins to allow for rotation of roller member 108. In one embodiment, the roller member 108 can comprise a wheel or roller.

As illustrated in the example of FIGS. 3A and 3B, examples of the roller member 108 are shown. The roller member 108 can comprise a cam shape or an actual rotating wheel. In alternate embodiments, the roller member 108 can comprise any suitable device that can come into contact with the ground surface as the assembly 100 expands, and provide certain capabilities for movement of the assembly 100 while in contact with the ground surface.

As is also shown in 204 of FIG. 2, the legs 102 are configured to move outward and upward, away from the ground surface. Once the legs 102 reach a predetermined position during the outward and upward movement, the legs 102 are configured to be moved towards the ground surface until they come in contact with the ground surface.

In one embodiment the assembly 100 includes an integrated four-bar and six-bar linkage system. As the angle between linkages changes through opening, it causes the rest of the assembly, mainly the leg members 102, to move in relation to the progress of that four-bar and six-bar linkage.

In 206, the legs 102 are moved towards the ground surface and the feet 106 come in contact with the ground surface. The continued movement of the legs 102 in 208 causes the assembly 100 in this example to lift upwards in the direction of arrow X1 and further away from the ground surface.

In 210, the assembly 100 is in the fully expanded state. The legs 102 are fully extended and the hub 104 is at the final position of its movement cycle.

FIGS. 3A and 3B illustrates an example of a leg 102 in a fully closed position or state. For the purposes of the description below, only one leg 102 will be described. Each leg 102 is configured to connect to the hub 104 at two locations. In one embodiment, there can be a rotating structural pin connection at the upper connection point of the leg 102, and a rotating structural pin connection at the lower connection point of the leg 102.

As shown in FIG. 3A, in the folded state of the assembly 100, the leg 102 is folded inwards, in a direction toward the hub 104. The rollers 108 can be configured to support the assembly 100 in the folded state and as the assembly 100 transitions from the folded to unfolded state.

FIG. 4 illustrates a more detailed example of a leg 102 in a partially extended state. In this example, the foot 106 is extended away from the hub 104. The roller 108 is attached to a middle leg element of the frame. The arrow 402 indicates the movement of the portion of the leg 102 to which the roller 108 is attached as the foot 106 comes into contact with the ground surface as the leg 102 continues to extend outward and downward. The force from the actuation cable or linear actuator causes motion in the four-bar and six-bar linkage which raises the entire assembly.

Figure 5:
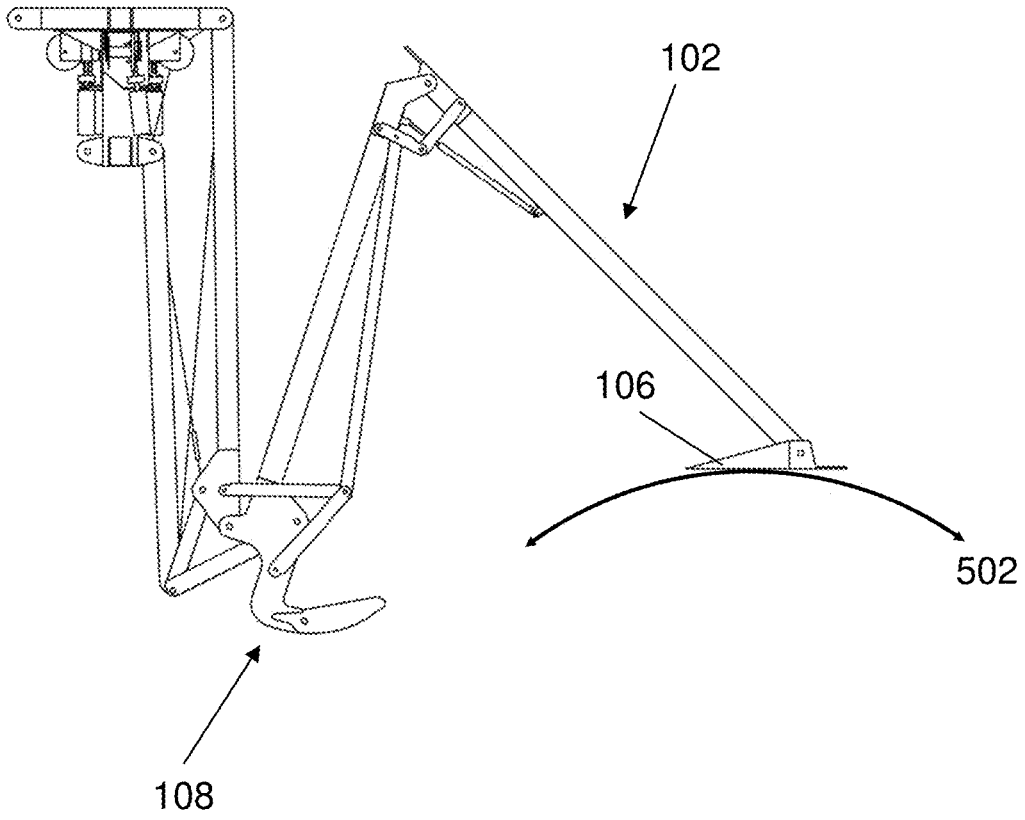
FIG. 5 illustrates an exemplary path of the foot member during folding and unfolding of an exemplary self-deploying shelter assembly incorporating aspects of the disclosed embodiments.

FIG. 5 illustrates the path 502 of the foot 106 of leg 102 as it moves away from the hub 104 towards the unfolded state. As is illustrated in the example of FIG. 5, the foot 106 of the leg 102 is never below the roller 108 until it extends to its furthermost position as shown in 206 of FIG. 2. In this manner, the foot 106 does not scrape against the ground surface during the transition of the assembly 100 from the folded state to the unfolded state.

The example of FIG. 4 illustrates the final foot position where the foot 106 comes in contact with the ground. The leg 102 continues to move and as the leg 102 expands, the hub 104 will start moving upwards in a vertical direction.

Once the legs 102 are in the position shown in FIG. 4, also referred to as a solid outrigger position, in one embodiment, the feet 106 can be staked. Staking the feet 106 can provide a mechanical advantage during the lift process. Additionally, the fabric that will be put over the assembly 100 can act as lateral stabilizer. In one embodiment, the fabric is typically installed on the frame before the installation or transition sequence. The fabric, including the top, liner, and floor, is able to remain over the frame at all times of the packing, transportation, unpacking, and lifting sequence.

Figure 6A:
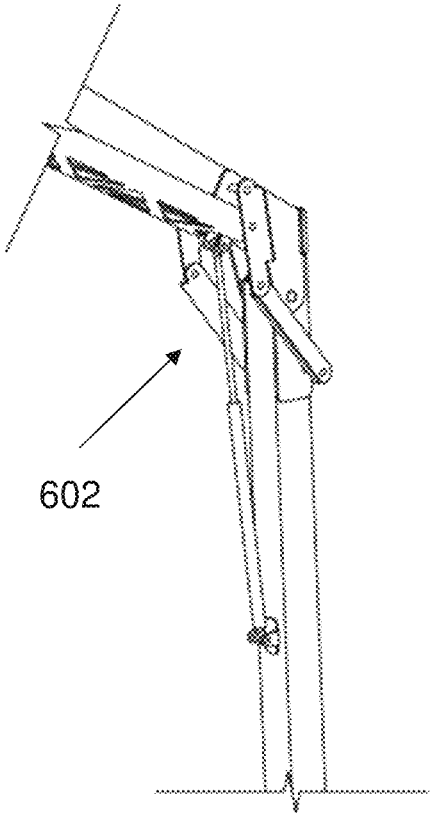
FIG. 6A illustrates the use of a strut with leg elements for an exemplary self-deploying shelter assembly incorporating aspects of the disclosed embodiments.
Figure 6B:
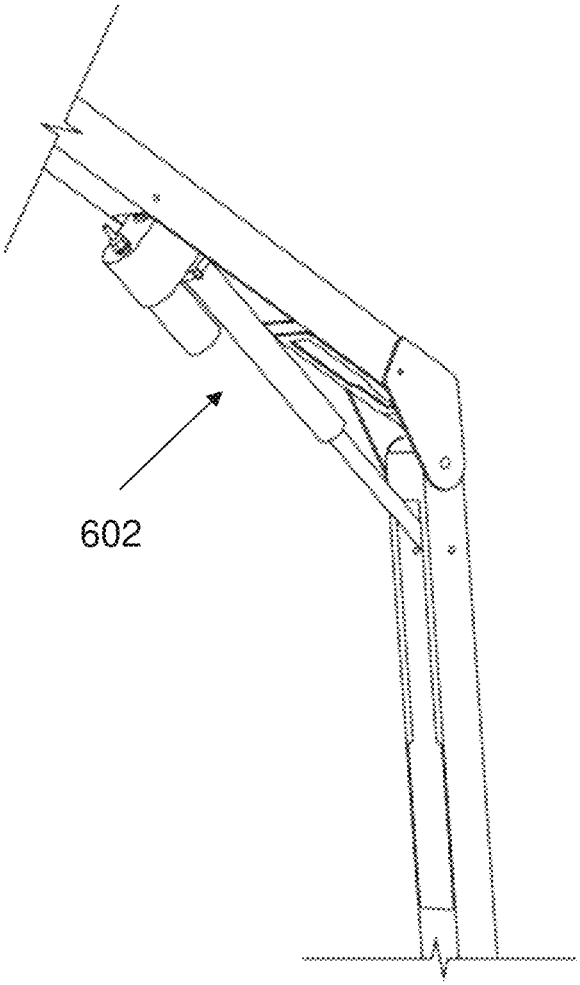
FIG. 6B illustrates the use of a linear actuator with leg elements for an exemplary self-deploying shelter assembly incorporating aspects of the disclosed embodiments.

Referring to FIGS. 6A and 6B, a strut 602, such as gas strut, FIG. 6A or linear actuator, FIG. 6B, can be connected between the different elements of the leg 102 to assist in the lifting process by providing force to the outer leg element. This strut 602 can either be attached to the assembly 100 via an integrated mounting location or through an additional bracket that is fastened to the member.

Figure 7:
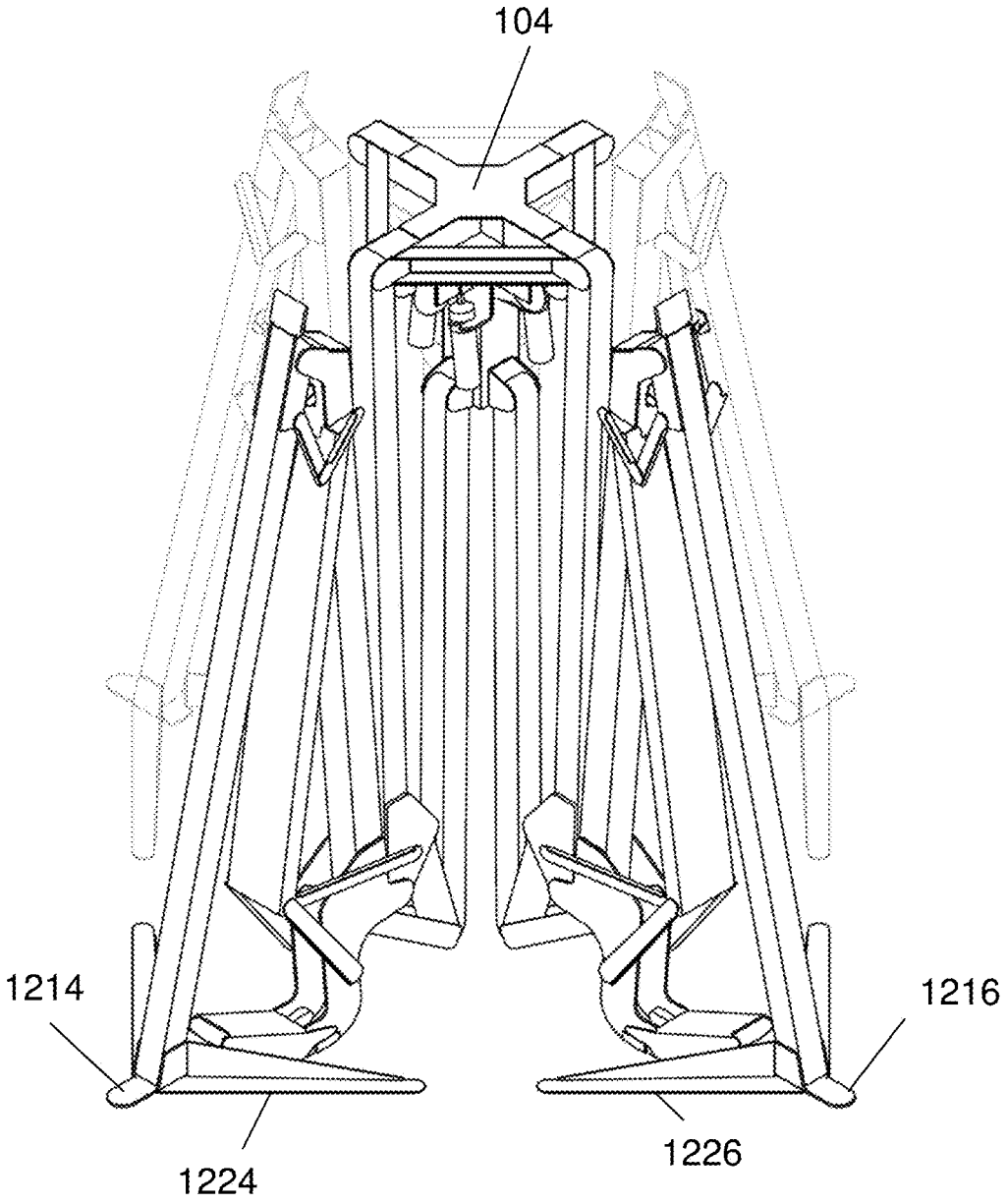
FIG. 7 illustrates another example of the folded state of an exemplary self-deploying shelter assembly incorporating aspects of the disclosed embodiments.

FIG. 7 illustrates the nested geometry of the assembly 100 in the folded state. This represents the most packed state of the assembly 100 for storage and shipping. As discussed herein, additional legs are connected to each available point in the hub 104 using fasteners to create the full assembly.

Figure 8:
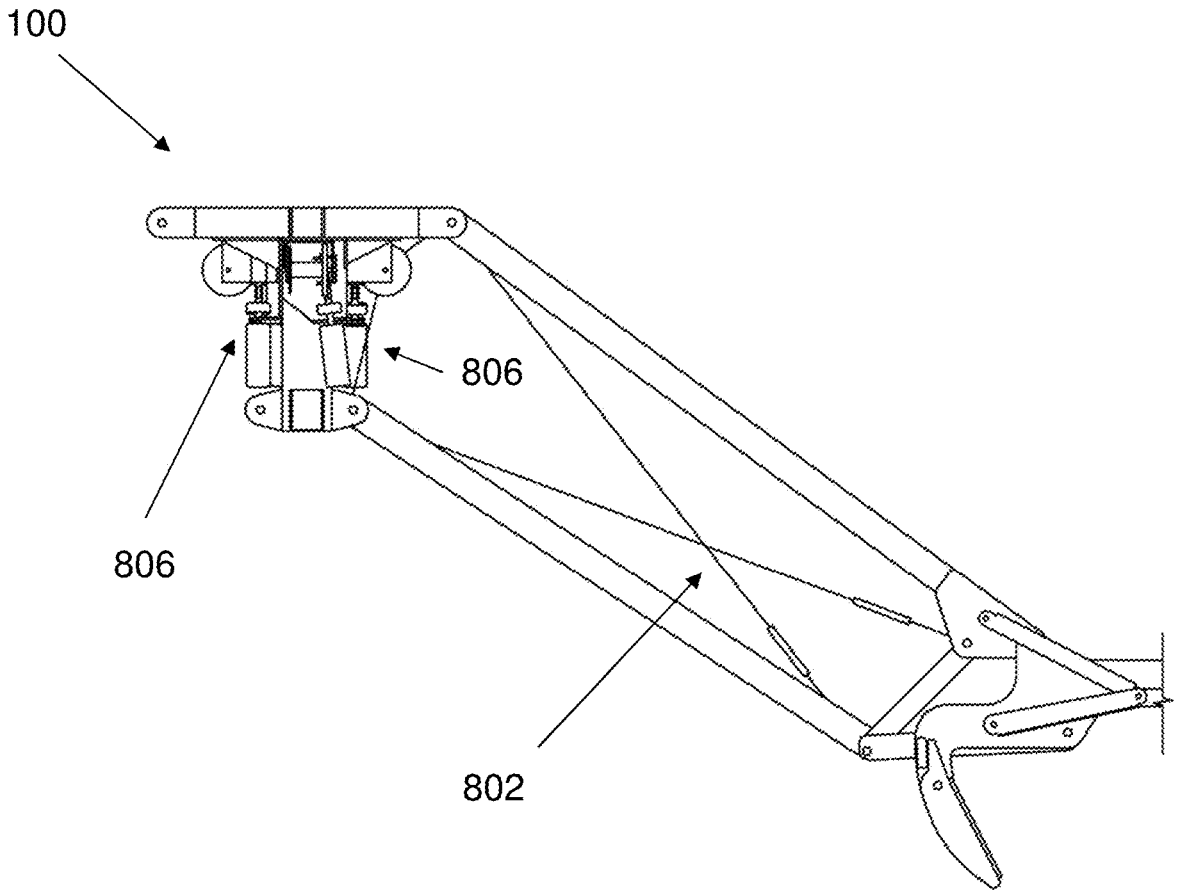
FIG. 8 illustrates one example of a cable assembly for an exemplary self-deploying shelter assembly incorporating aspects of the disclosed embodiments.

FIG. 8 illustrates one embodiment of a possible actuation system using linear actuators or cables 802 that can be connected to and between the different elements of the legs 102. By either expanding or contracting, it causes the six bar linkage system to change geometry and lift the assembly. For purposes of the description herein, the cables 802 can also be referred to as ropes or rope paths. In one embodiment, the cables 802 can be connected to an actuator device 806 to control the deployment (folding and unfolding) of the assembly 100. FIG. 8 shows two actuator devices 806. Generally, there will be one actuator device 806 per leg 102 of the assembly 100.

In one embodiment there is one or more sensors on each leg that are configured to provide or sense the angles of each leg 102 relative to the hub 104. Each leg 102 can be synchronized by keeping the angle of each leg 102 within tolerance of the other legs 102 throughout the opening sequence. Although synchronization is preferred, it is not required. The assembly 100 is configured to be flexible enough to move without full synchronization.

Figure 9A:
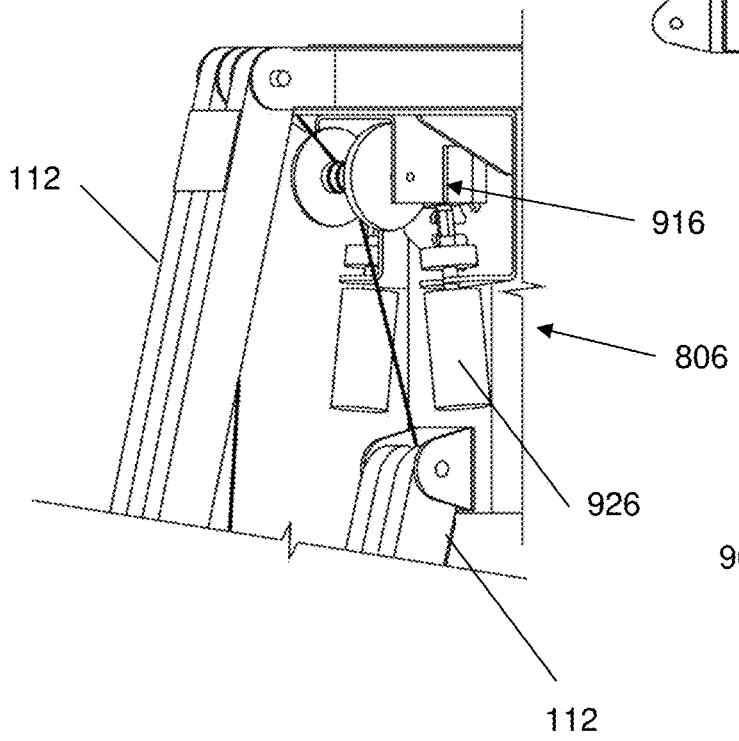
FIG. 9A illustrates the use of a drive motor with a cable assembly for a self-deploying shelter assembly incorporating aspects of the disclosed embodiments.
Figure 9B:
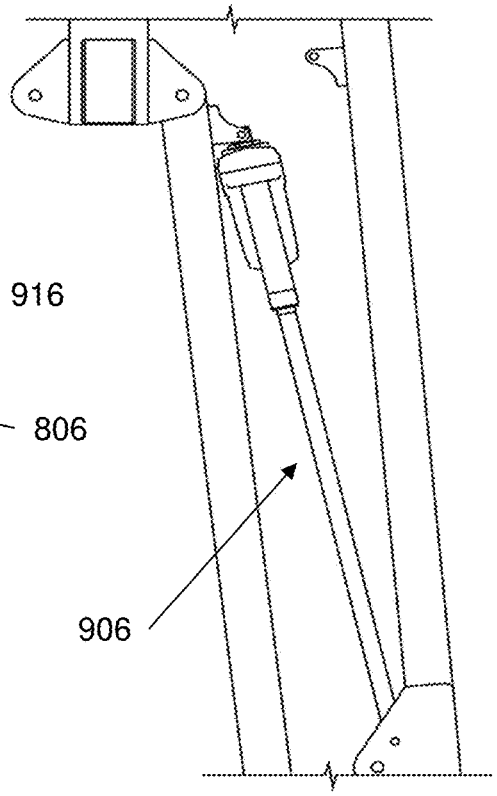
FIG. 9B illustrates the use of a linear actuator rather than a drive motor.

Examples of actuator devices or assemblies 806 are shown in FIGS. 9A and 9B. In Figure A, the actuator device 906 includes a rope winch 916 and a drive motor 926. The rope winch 916 is connected to the cables 802 of FIG. 8 and are driven by the drive motor 926 to control the folding and unfolding of the assembly 100.

FIG. 9B shows a linear actuator 906 that elongates or shortens to control the folding and unfolding. The actuator devices 806, 906 in both examples is disposed between the elements inner member and long link of a leg 102.

Figure 10:
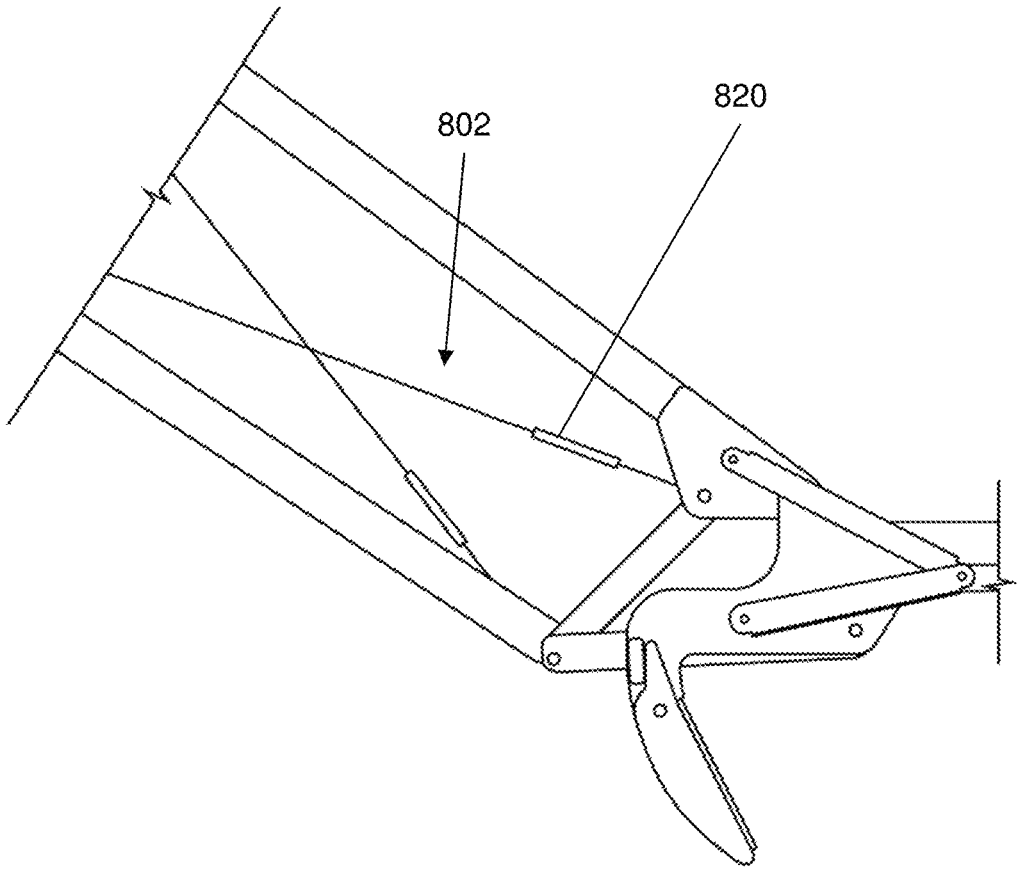
FIG. 10 illustrates the use of a spring tensioner with a cable assembly for a self-deploying shelter assembly incorporating aspects of the disclosed embodiments.

In one embodiment, as shown in FIG. 10, the cables 802 can include integrated spring tensioners 820 or actively controller linear actuators. The string tensioners can be integrated in line with the cable between the winch and the connection point on the inner member.

Figure 11:
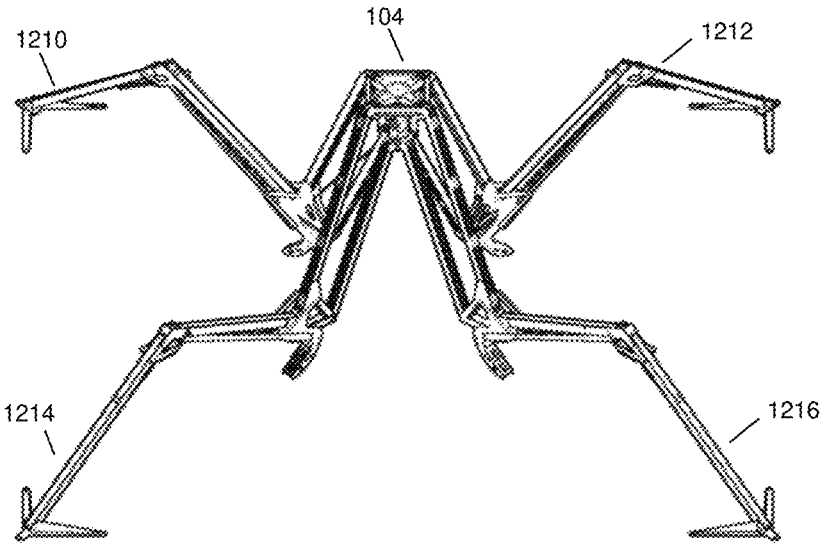
FIG. 11 illustrates a partially unfolded state of the frame of a self-deploying shelter assembly incorporating aspects of the disclosed embodiments.

FIG. 7 illustrates, the assembly 100 is in the fully closed state. The illustrated elements of the assembly 100 include the hub 104, leg 1210, leg 1212, leg 1214 and leg 1216. The feet 1224 and 1226, shown in this example, in contact with the ground surface FIG. 11 illustrates the assembly 100 in the ready to lift state. In this example, the legs 1210, 1212, 1214 and 1216 are extended, and the corresponding feet are in contact with ground. The hub 104 is configured to move in an upward direction.

Figure 12:
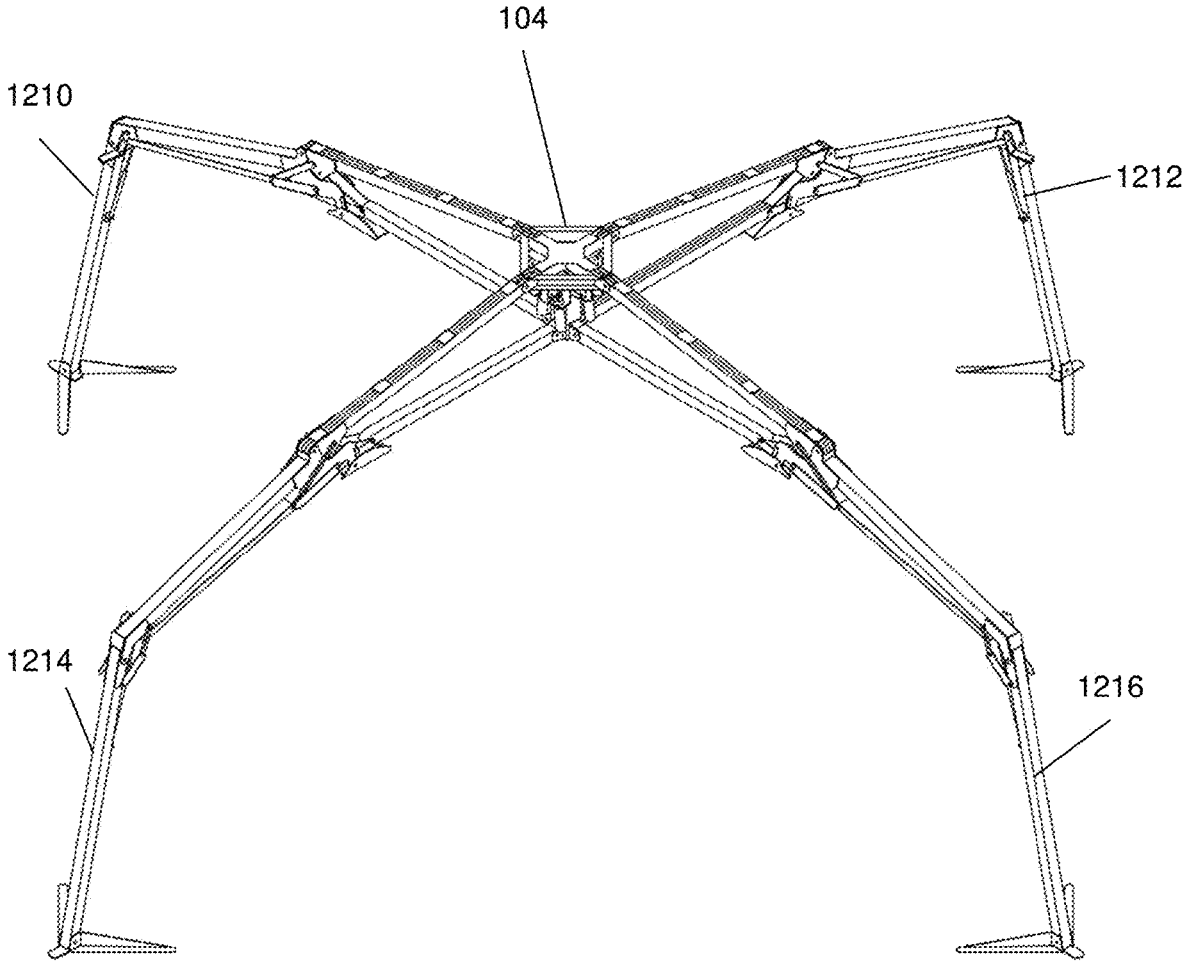
FIG. 12 illustrates an unfolded state of the frame of a self-deploying shelter assembly incorporating aspects of the disclosed embodiments.

FIG. 12 illustrates the fully open state. The legs 1210, 1212, 1214 and 1216 are fully extended and the hub 104 is has reach its final position.

Figure 13:
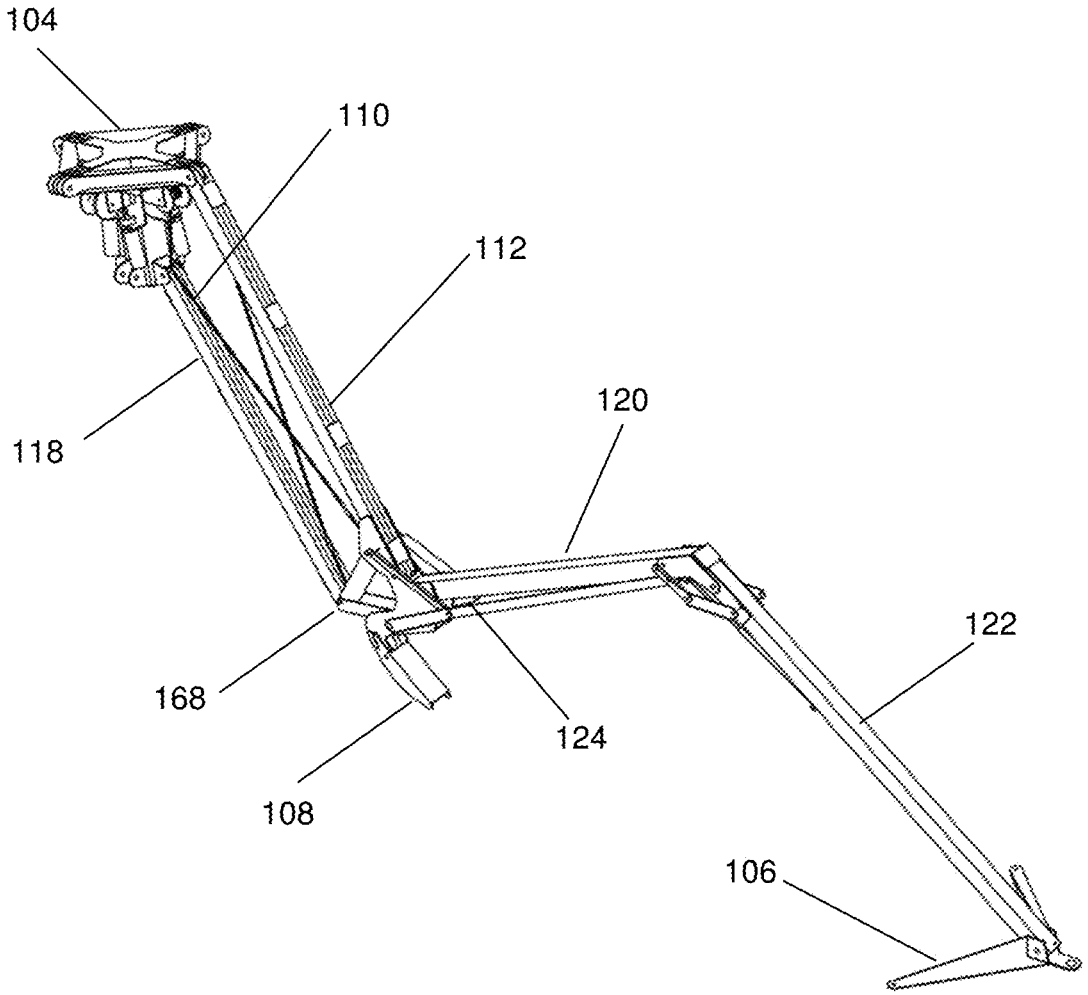
FIG. 13 illustrates an example of a partially extended leg member of a self-deploying shelter assembly incorporating aspects of the disclosed embodiments.

FIG. 13 illustrates a view of the assembly of a single leg incorporating aspects of the disclosed embodiments. In this example, the assembly includes the rope or cable system 110, an inner element or member 112, a long link member 114, a medium link member 116, a short link member 118, and middle member 120, a roller member 108, an outer member control linkage system 124, and outer member 122, and a foot 106.

Figure 14:
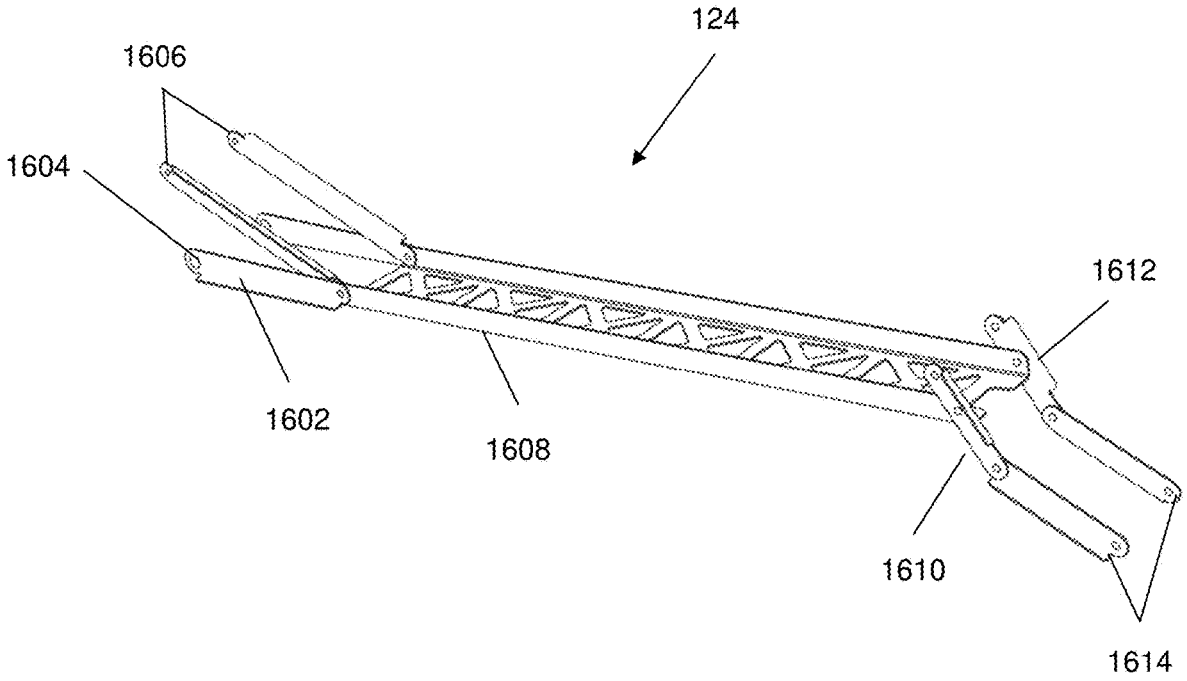
FIG. 14 illustrates an exemplary leg member and connection elements for a self-deploying shelter assembly incorporating aspects of the disclosed embodiments.

FIG. 14 illustrate an example of an outer member control linkage 124 incorporating aspects of the disclosed embodiments. In this example, the outer member control linkage system 124 includes a crank 1602, crank 1604, crank puller 1606, connector 1608, brace 1610, brace 1612, and brace 1614.

Figure 15:
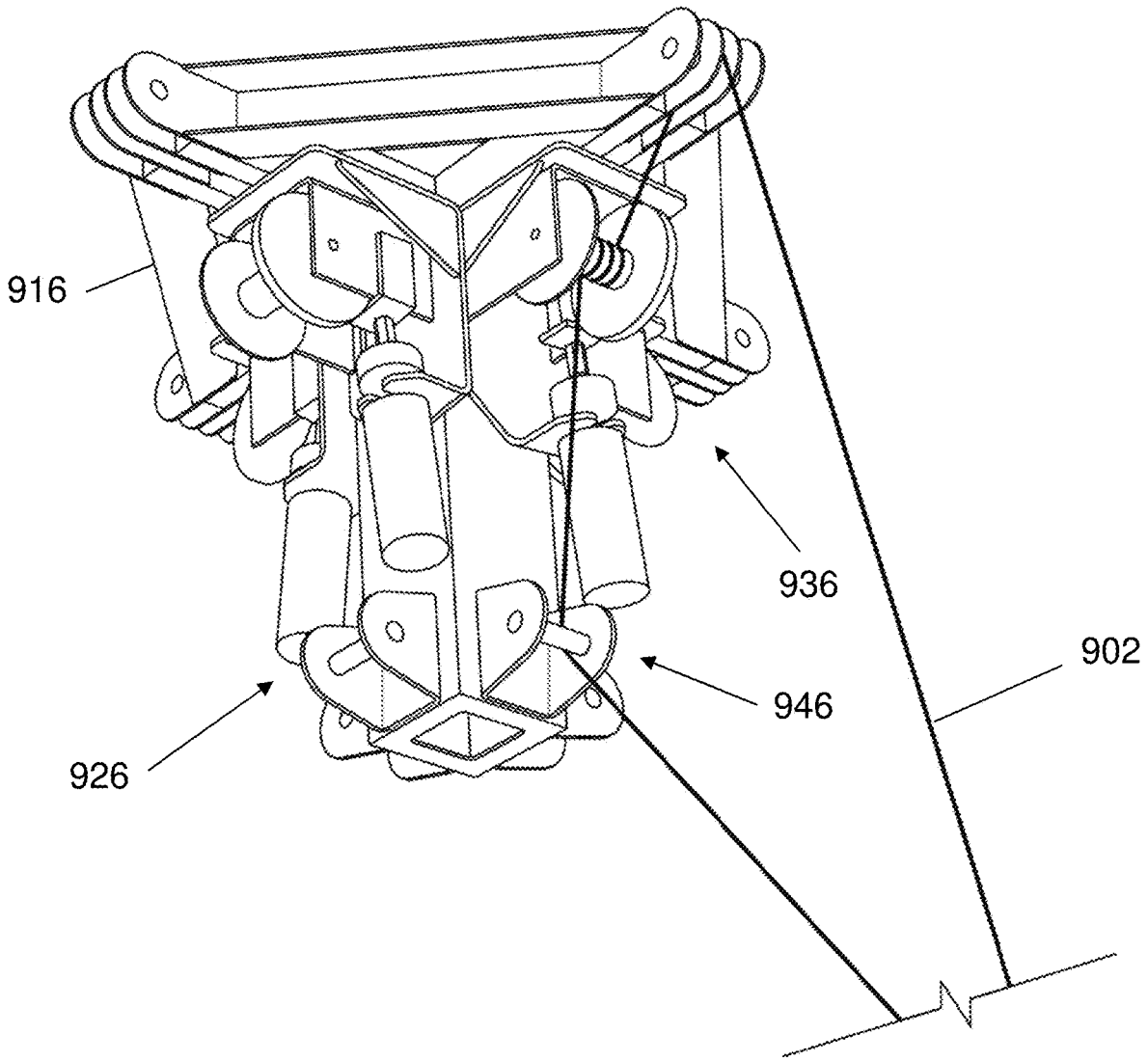
FIG. 15 is a view of the underside of a hub for a self-deploying shelter assembly incorporating aspects of the disclosed embodiments.

FIG. 15 illustrates one example of a hub and drive system assembly incorporating aspects of the disclosed embodiments. In this example, the hub and drive system assembly includes drive motor 926, rope winch 916, motor shaft coupling 936, cable pulley 946, and a High Modulus Polyethylene (HMPE) Rope 902.

Figure 16:
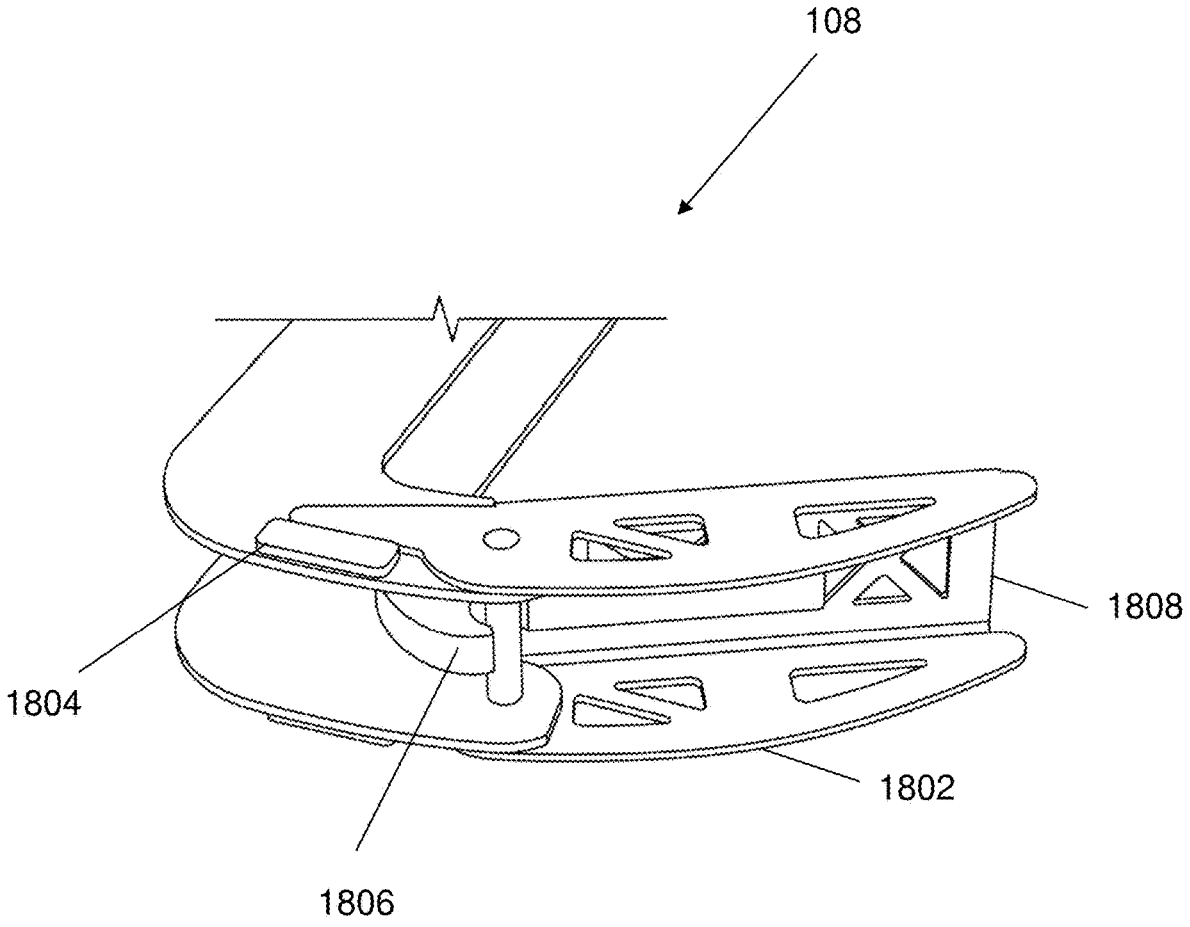
FIG. 16 illustrates an exemplary roller member for a self-deploying shelter assembly incorporating aspects of the disclosed embodiments.

FIG. 16 illustrates an example of a roller 108 incorporating aspects of the disclosed embodiments. In this example, the roller 108 is a pivoting roller assembly. In one embodiment, the roller 108 can include a roller pivot 1802, a hard stop 1804, a cam surface 1806, and a spacer support 1808.

Figure 17:
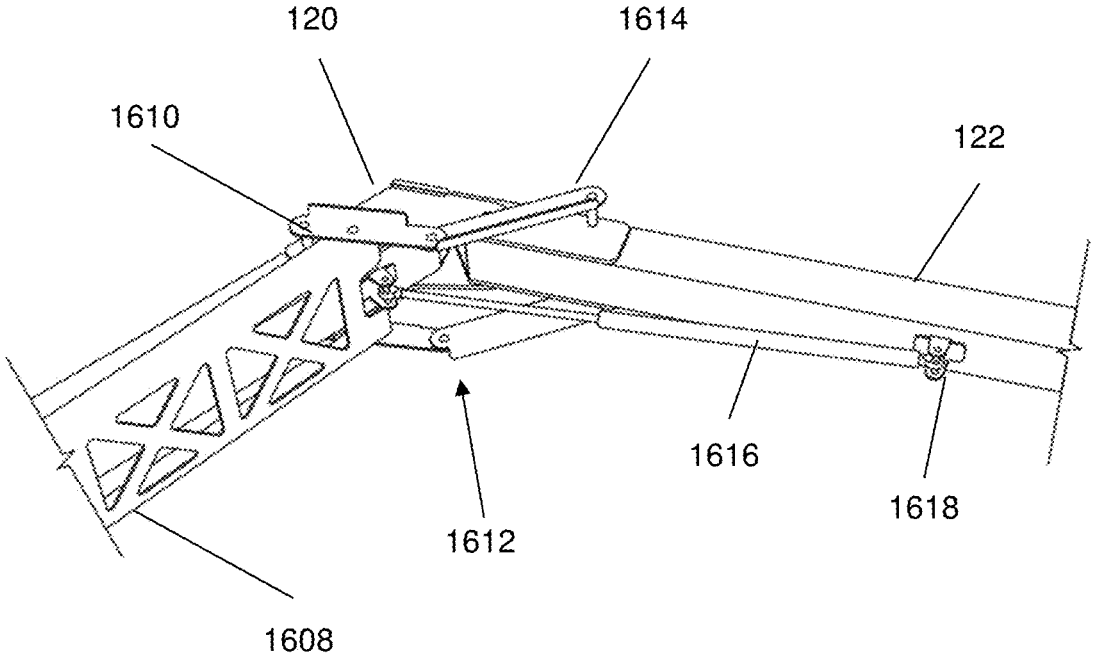
FIG. 17 illustrates an exemplary connection of leg elements for a self-deploying shelter assembly incorporating aspects of the disclosed embodiments.

FIG. 17 illustrates an example of an outer member deployment system assembly incorporating aspects of the disclosed embodiments. In this example, the outer member deployment system assembly includes middle member 120, connector 1608, brace 1610, another brace 1612, which is a mirror of brace 1610, second brace 1614, gas spring 1616, a mounting bracket 1618, and an outer member 122.

FIGS. 18-24 illustrate one example of the opening of a rapidly deployable shelter assembly incorporating aspects of the disclosed embodiments.

Figure 18:
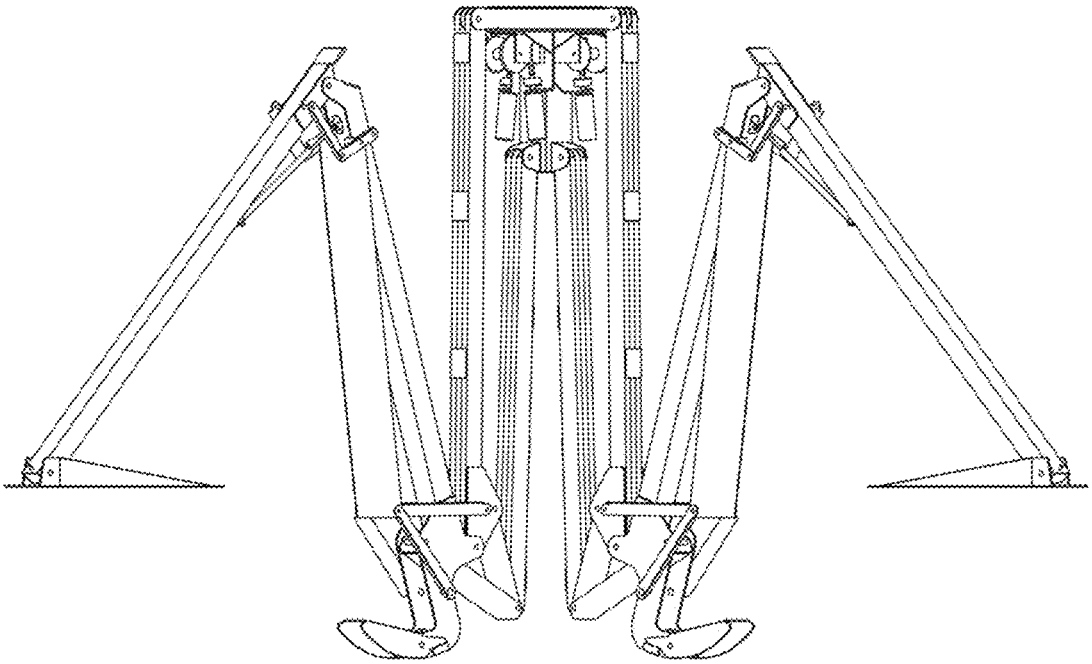
FIGS. 18-25 illustrates an exemplary series of movements and states from the unfolded state to the folded state for a self-deploying shelter assembly incorporating aspects of the disclosed embodiments.

In FIG. 18, the assembly is shown beginning to open or unfold. The legs start to go outward, away from the center. The roller helps prevent the feet from scraping the ground during the opening.

Figure 19:
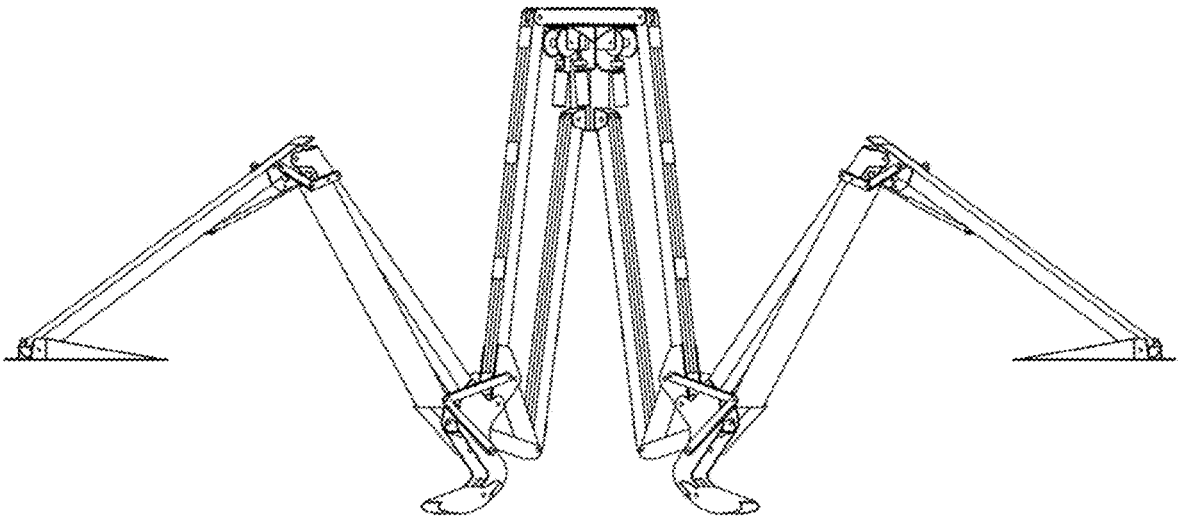

In FIG. 19, the assembly is halfway open. The feet do not come in contact with the ground until the assembly is in the ready to lift state.

Figure 20:
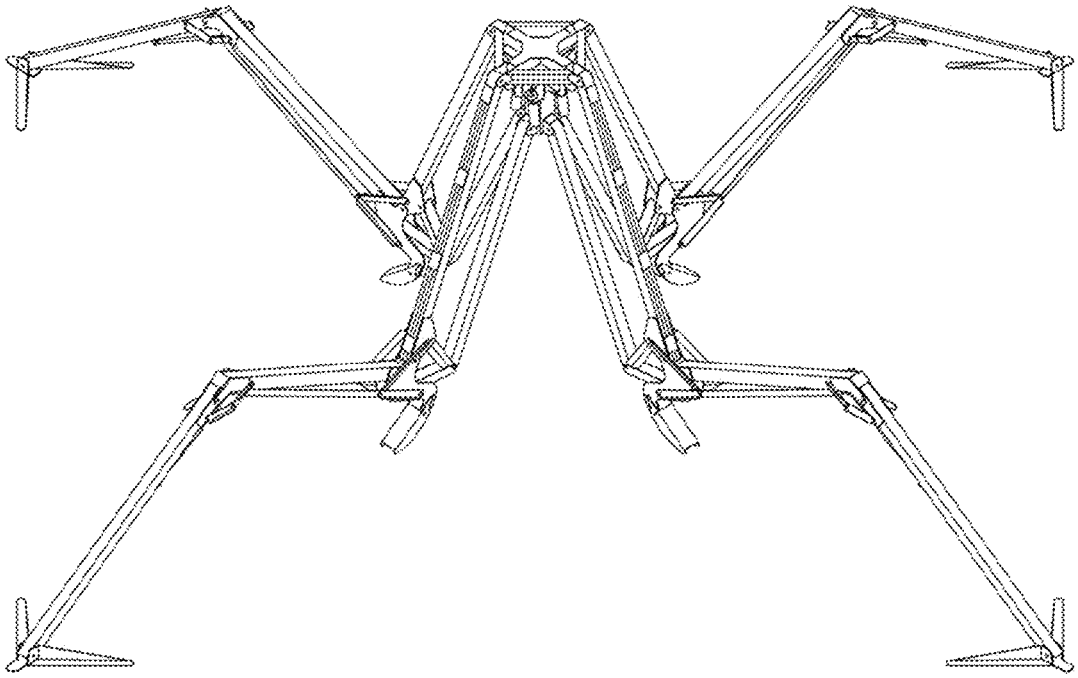

In FIG. 20, the ready to lift state is reached. The feet are now in contact with the ground. The hub will start to move upwards and the legs will extend or straighten.

Figure 21:
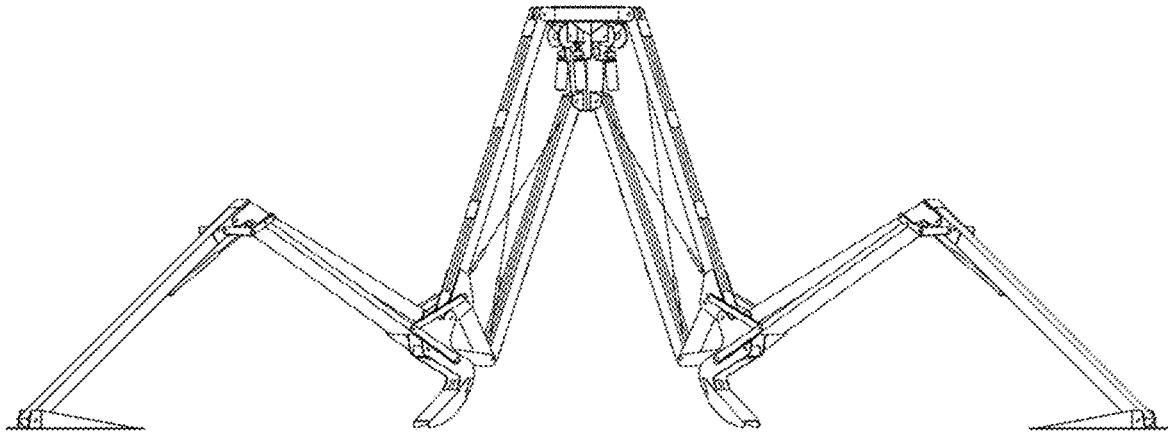

FIG. 21 is a side view of FIG. 20. In one embodiment, the feet can be staked at this point and will no longer move.

Figure 22:
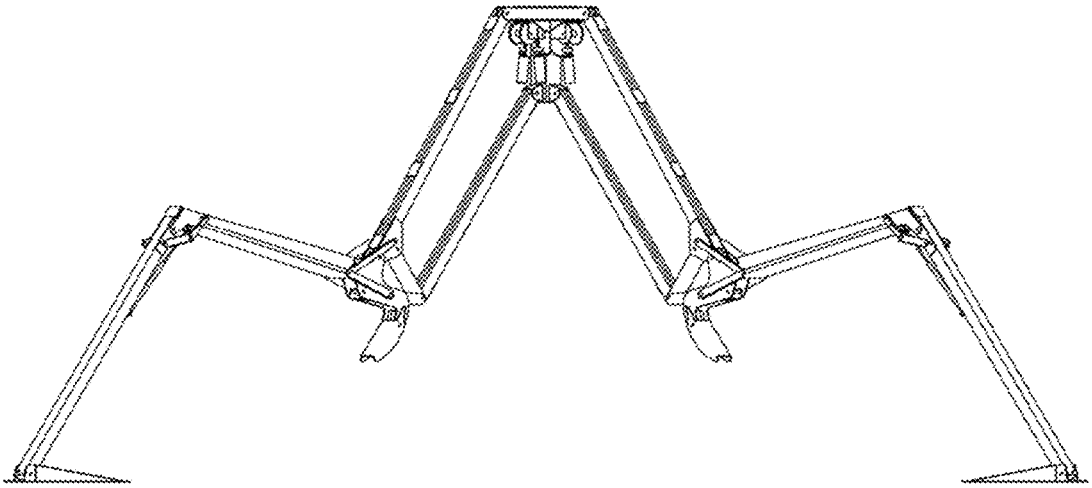
Figure 23:
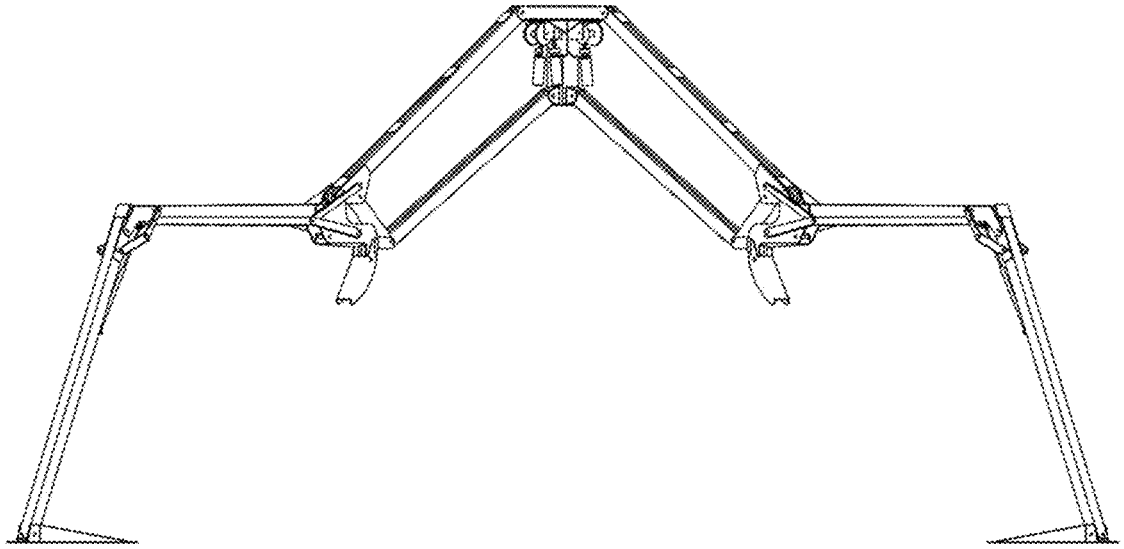
Figure 24:
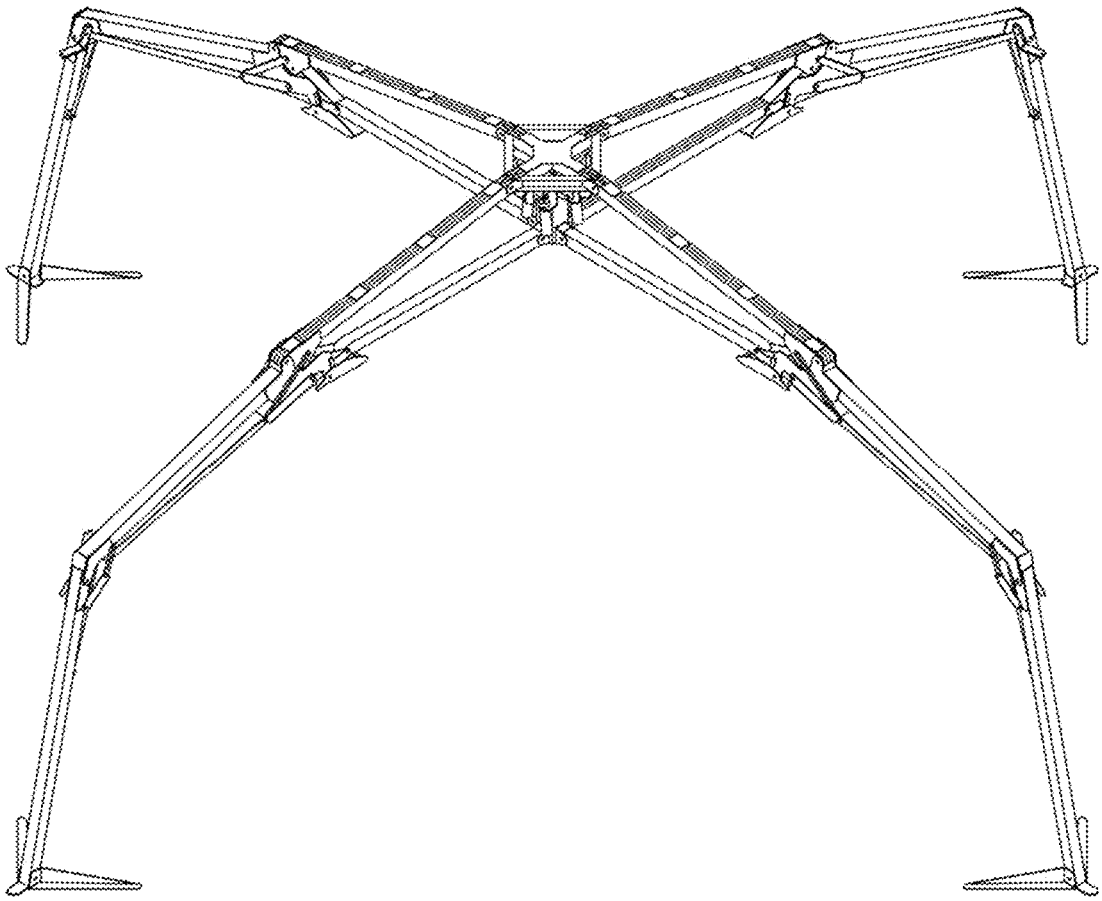
Figure 25:
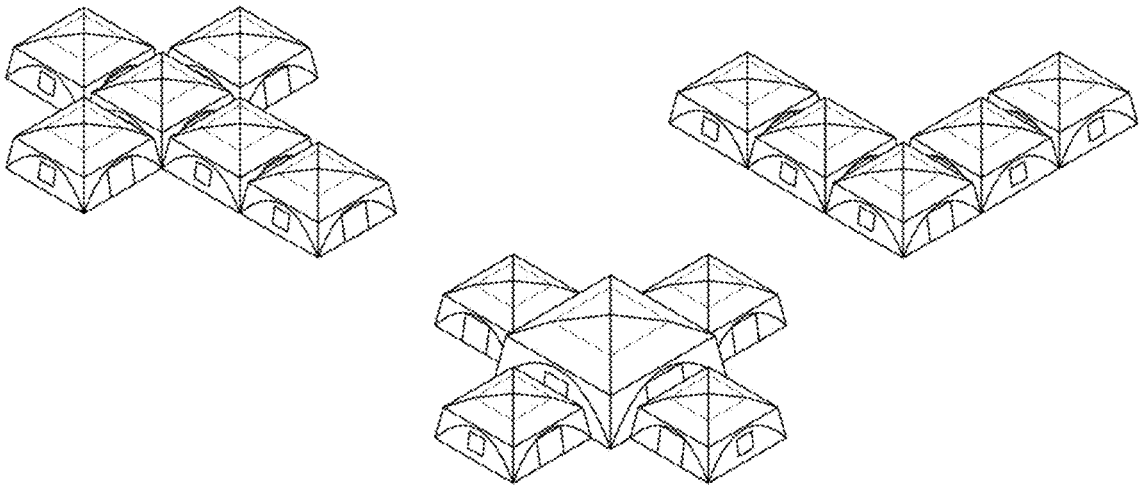
Figure 26:
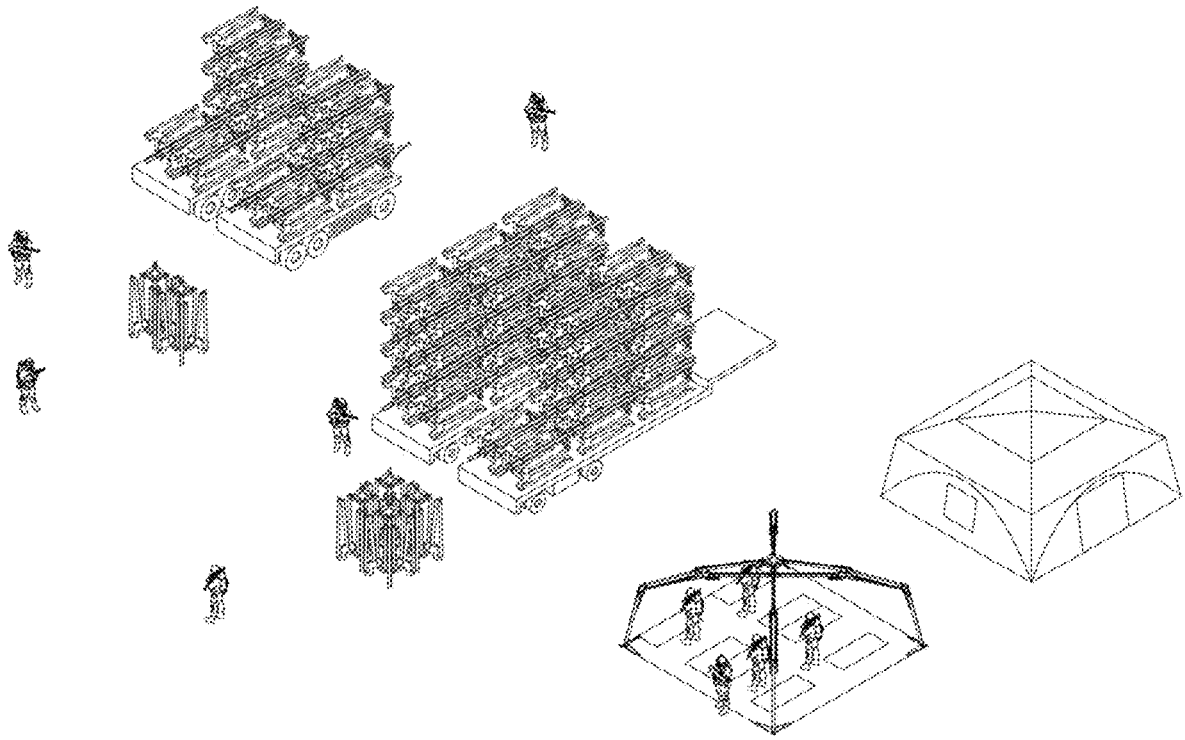
FIG. 26 illustrates an exemplary implementation of a plurality of self-deploying shelter assemblies incorporating aspects of the disclosed embodiments.
Figure 27:
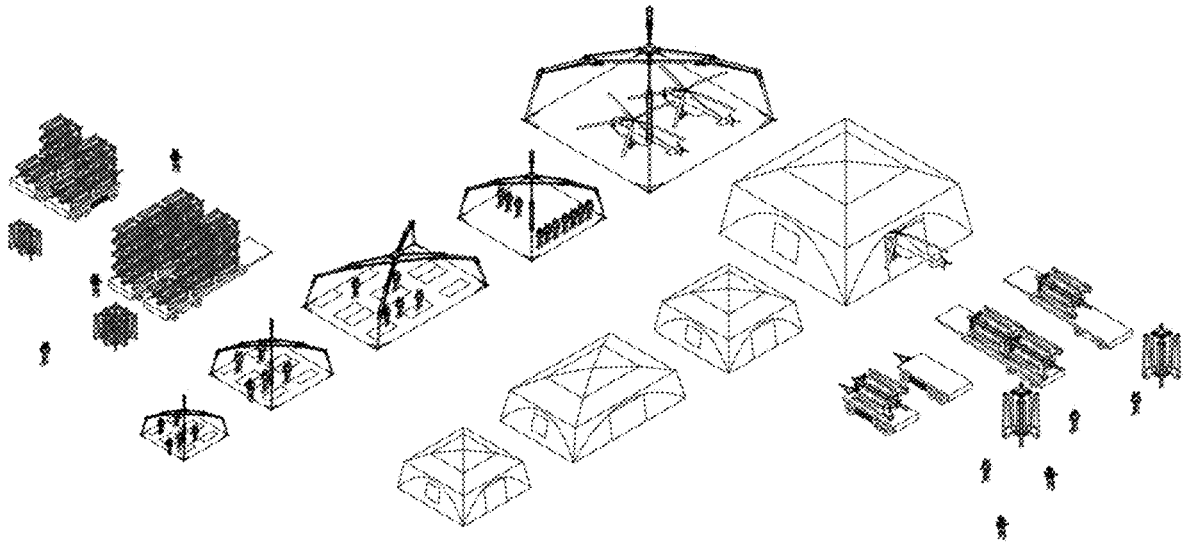
FIGS. 27-28 illustrate exemplary implementations of one or more self-deploying shelter assemblies incorporating aspects of the disclosed embodiments.
Figure 28:
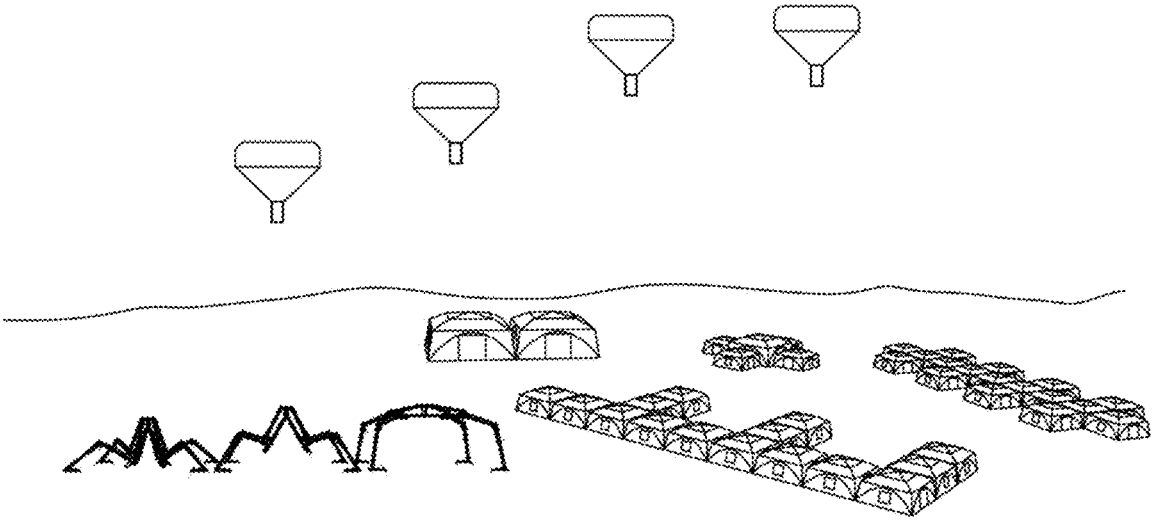

FIG. 22 illustrates how the rollers have lifted away from the ground. In FIG. 23, the assembly is in the halfway open state. In FIG. 24, the assembly is in the fully open state.

Enhancements to the HEXT structure can include, but are not limited to, hardening for protection and integrating self-powering solar cells to achieve autonomy, power for lighting and electronics, and climate control.

FIGS. 25-28 illustrate various exemplary implementations of a rapidly deployable shelter assembly incorporating aspects of the disclosed embodiments.

Features of the fully autonomous self-deploying shelter assembly 100 of the disclosed embodiments include, but are not limited to:

1. A crossed-arch scheme with four (4) or more legs 102 made of three (3) segments folding in a zigzag pattern.
2. Legs that open from the middle and reach their final position before lifting.
3. Legs that do not drag ever.
4. Legs that are in a solid outrigger position (and staked) for lift with mechanical advantages.
5. The fabric over the structure can act as a lateral stabilizer. The main fabric and floor fabric act as primary structural stabilizers for the frame structure during the installation, the use of the shelter and the dismantling of the shelter, and are an integral part of the structural mechanism and structural load bearing. The stabilization of the structural frame by the fabric during installation allows the frame to be lighter in weight and less rigid at the joints-more flexible and deflect from higher stresses. Aspects of the fabric, such as stiffened areas of fabric, or bungee cords embedded in the fabric membrane are configured to help control the frame folding and are part of the mechanisms.
6. The linear actuator on each leg creates four (4) degrees of freedom.
7. A self-righting capability if the system is on its side initially.
8. Self-balancing, accelerometer-integration.
9. Fully integrated with fabric, floor, and a liner.
10. Can be remotely operated or operated in person.
11. The assembly 100 is configured to walk and move itself to an optimal position, find level ground using integrating angle sensors. Each leg 102 has the ability to move independently. Therefore, one leg can close partially at a time, creating a sequence where the system closes partially, leans to one side, and extends out for movement.
12. Multiple units can walk to each other to automatically connect and sync up.
13. Has a modular actuation system for one (1) or multiple degrees of freedom.
14. Has a minimal frame and minimum weight configuration.
15. Is made of folded aluminium panels or extruded metals or composites. The folded legs nest within one another with structural stability.
16. Has a lightweight and efficient structural design.
17. Has a unique ornamental design.
18. Has a six (6)-bar linkage system combined with a seven (7)-bar linkage system.
19. Includes control logic for opening and closing, error control and system integration.
20. Is fully self-powered with self-powering solar integration.
21. Can be used with rigid flooring. Also has an integrated folded floor concept.
22. There is control of the fabric folding when closing by using embedded elastic members.
23. There is integration of Teflon washers and unique pin joints.
24. Uses cable actuation to control system deployment.
25. The integrated pull-bar springs support stability and allow continuous opening for self-balancing.
26. Adaptable for a larger-scale truck/trailer mounted hydraulic system.
27. Also adaptable for airdrop deployment, autonomous vehicle dropping and parachute deployment.
28. Enables the auto-build of forward operating base(s) or deployable tent cities without human intervention.
29. The system self-closes.
30. Links are connected using driftpin shoulder bolt attachments.
31. Passive gas spring stabilization is used during opening and closing of the legs.
32. The system has amobile power unit and control box with weatherproof receptacles.
33. The system includes a stop-start quick disconnect controller.
34 The system includes an E-stop (emergency stop) button for safety during building and deployment.

While there have been shown, described and pointed out, fundamental novel features of the invention as applied to the exemplary embodiments thereof, it will be understood that various omissions, substitutions and changes in the form and details of devices and methods illustrated, and in their operation, may be made by those skilled in the art without departing from the spirit and scope of the presently disclosed invention. Further, it is expressly intended that all combinations of those elements, which perform substantially the same function in substantially the same way to achieve the same results, are within the scope of the invention. Moreover, it should be recognized that structures and/or elements shown and/or described in connection with any disclosed form or embodiment of the invention may be incorporated in any other disclosed or described or suggested form or embodiment as a general matter of design choice.

What is claimed is:

1. A self-deploying shelter assembly configured to deploy from a folded state to an unfolded state and from the unfolded state to the folded state, the shelter assembly comprising:

a plurality of legs;

a hub, the hub being configured to be coupled to one end of respective legs of the plurality of legs, wherein a leg of the plurality of legs comprises:

a first leg element, a second leg element and a third leg element, a second end of the third leg element being movably coupled to the hub;

a foot member coupled to a first end of the first leg element, a second end of the first leg element being movably coupled to a first end of the second leg element and a second end of the second leg element being movably coupled to the first end of the third leg element; and a roller member coupled to one or more of the second end of the second leg element and the first end of the third leg element, the roller member being configured to contact a ground surface when the self-deploying shelter is in the folded state; and when the hub member causes the plurality of legs to extend outwards, the first leg element and the second leg element extend outwards a pre-determined distance until the foot member comes in contact with a ground surface.

2. The shelter assembly according to claim 1, wherein the hub is configured to:

cause a movement of the plurality of legs outward, away from the hub, when the shelter assembly is deploying from the folded state to the unfolded state; and cause a movement of the plurality of legs inward, toward the hub, when the shelter assembly is deploying from the unfolded state to the folded state.

3. The shelter assembly according to claim 1, wherein the roller member comprises a curved member that extends from a bottom of the shelter assembly to make contact with the ground surface when the shelter assembly is in the folded state.

4. The shelter assembly according to claim 1, wherein the foot member is away from the ground surface in the folded state of the shelter assembly.

5. The shelter assembly according to claim 1, wherein the contact of the foot member with the ground surface while the hub is extending the plurality of legs causes the hub to move in an upwards direction, away from the ground surface.

6. The shelter assembly according to claim 1, wherein the foot member is disposed closer to the hub than the roller member in the folded state of the assembly.

7. The shelter assembly according to claim 1, wherein the first leg element is pivotally connected to the foot member and the second leg element.

8. The shelter assembly according to claim 1, wherein the second leg element is pivotally connected to the third leg element.

9. The shelter assembly according to claim 1, wherein the roller member comprises a bracket that is pivotally connected to the third leg element and the second leg element.

10. The shelter assembly according to claim 1, wherein the foot member moves along an arced path when moving to and from the folded state and unfolded state of the shelter assembly.

11. The shelter assembly according to claim 10, wherein when the shelter assembly deploys from the folded state to the unfolded state, the hub is configured to cause:

the first end of the first leg element to move in an upward direction away from the ground surface, wherein the first end of the first leg element is moving along the arced path;

the first end of the second leg element to move away from a centerline of the hub and third leg element;

the foot member to come in contact with the ground surface when the first leg element and the second leg element reach pre-determined positions;

the roller member to move away from the ground surface after the foot member comes in contact with the ground surface and the third leg element extends;

the shelter assembly to reach the unfolded state once the third leg element is fully extended.

12. The shelter assembly according to claim 10, wherein when the shelter assembly deploys from the unfolded state to the folded state, the hub is configured to cause:

the third leg element to retract from a fully extended position until the roller member comes in contact with the ground surface;

the foot member to lift off the ground surface after the roller member comes in contact with the ground surface; and the second leg element and the first leg element to retract to the folded state of the shelter assembly, while the foot member moves along the arched path, without further contact with the ground surface.

13. The shelter assembly according to claim 1, wherein the third leg element comprises a first leg member spaced apart from a second leg member, a first end of the first leg member and a first end of the second leg member are pivotally connected to the hub, and a second end of the first leg member is coupled to a roller arm bracket.

14. The shelter assembly according to claim 13 further comprising an actuator or cable assembly connected to and between the hub, the first leg member and the second leg member, the actuator or cable assembly being configured to move the first leg member and the second leg member when extended and retracted by a spool assembly on the hub.

15. The shelter assembly according to claim 14 further comprising a drive motor connected to the hub and the spool assembly, the drive motor configured to cause the spool assembly to extend and retract a cable member.

16. The shelter assembly according to claim 1, further comprising a linkage system coupled to the plurality of legs, the linkage system configured to cause an individual leg to open to the unfolded state and close to the folded state along a prescribed path.

17. The shelter assembly according to claim 16, wherein the linkage system is connected between the hub and the individual leg of the plurality of legs.

18. The shelter assembly according to claim 16, wherein the linkage system is connected to an actuator or cable assembly.

* * * * *